US009353553B2

(12) United States Patent
Funayama et al.

(10) Patent No.: US 9,353,553 B2
(45) Date of Patent: May 31, 2016

(54) IMAGE FORMING APPARATUS WITH LOCKING DRAWER UNIT

(71) Applicants: Yusuke Funayama, Kanagawa (JP); Joh Ebara, Kanagawa (JP); Hiroshi Ishii, Kanagawa (JP); Junichi Kawase, Kanagawa (JP); Kohta Takenaka, Kanagawa (JP); Tetsuji Nishikawa, Tokyo (JP); Yoshihide Ohta, Kanagawa (JP); Kouta Hirakawa, Tokyo (JP); Toshihiro Shimada, Kanagawa (JP); Tsuyoshi Endo, Kanagawa (JP)

(72) Inventors: Yusuke Funayama, Kanagawa (JP); Joh Ebara, Kanagawa (JP); Hiroshi Ishii, Kanagawa (JP); Junichi Kawase, Kanagawa (JP); Kohta Takenaka, Kanagawa (JP); Tetsuji Nishikawa, Tokyo (JP); Yoshihide Ohta, Kanagawa (JP); Kouta Hirakawa, Tokyo (JP); Toshihiro Shimada, Kanagawa (JP); Tsuyoshi Endo, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 68 days.

(21) Appl. No.: 14/103,941

(22) Filed: Dec. 12, 2013

(65) Prior Publication Data

US 2014/0167580 A1 Jun. 19, 2014

(30) Foreign Application Priority Data

Dec. 13, 2012 (JP) ..... 2012-272773

(51) Int. Cl.

| | |
|---|---|
| ***G03G 15/00*** | (2006.01) |
| ***B41J 29/54*** | (2006.01) |
| ***E05B 65/44*** | (2006.01) |
| ***E05B 47/00*** | (2006.01) |
| ***E05B 47/02*** | (2006.01) |
| ***E05B 65/46*** | (2006.01) |
| ***E05C 3/30*** | (2006.01) |
| ***E05B 15/02*** | (2006.01) |
| ***B65H 7/06*** | (2006.01) |

(52) U.S. Cl.

CPC *E05B 65/44* (2013.01); *B65H 7/06* (2013.01); *E05B 15/021* (2013.01); *E05B 47/0012* (2013.01); *E05B 47/023* (2013.01); *E05B 65/46* (2013.01); *E05C 3/30* (2013.01); *B65H 2402/64* (2013.01); *B65H 2407/20* (2013.01); *B65H 2511/414* (2013.01); *B65H 2511/528* (2013.01); *B65H 2601/11* (2013.01)

(58) Field of Classification Search

CPC ..... B41J 29/54; B41J 29/56; B41J 29/58; E05B 65/44

See application file for complete search history.

(56) References Cited

U.S. PATENT DOCUMENTS 4,872,659 A * 10/1989 Kato ..... B65H 3/44 271/111
5,307,116 A * 4/1994 Ikunami et al. ..... 399/18
5,413,409 A * 5/1995 Arai ..... 312/330.1

(Continued)

FOREIGN PATENT DOCUMENTS

JP 01-142764 6/1989
JP 10-268596 10/1998

(Continued)

*Primary Examiner* — Blake A Tankersley
*Assistant Examiner* — Ruben Parco, Jr.
(74) *Attorney, Agent, or Firm* — Harness, Dickey & Pierce, P.L.C.

(57) ABSTRACT

An image forming apparatus includes an image forming unit configured to form an image; a drawer unit configured to be pulled out from a body of the image forming apparatus; a first lock unit configured to receive power from a power supply and perform at least one of lock and unlock of the drawer unit with respect to the body; and a second lock unit configured to perform lock and unlock of the drawer unit with respect to the body by a mechanical operation performed by an operator.

10 Claims, 33 Drawing Sheets

(56) References Cited

U.S. PATENT DOCUMENTS

| | | | | |
|---|---|---|---|---|
| 5,797,068 | A | 8/1998 | Otsuki et al. | |
| 2010/0158560 | A1* | 6/2010 | Watanabe | G03G 21/1633 399/110 |
| 2011/0007339 | A1* | 1/2011 | Negishi | 358/1.14 |

FOREIGN PATENT DOCUMENTS

| | | | | |
|---|---|---|---|---|
| JP | 2001121795 | A * | 5/2001 | B41J 29/54 |
| JP | 2001-261189 | | 9/2001 | |
| JP | 2005-084181 | | 3/2005 | |
| JP | 2006-293397 | | 10/2006 | |
| JP | 2007-175979 | | 7/2007 | |
| JP | 2008062612 | A * | 3/2008 | B41J 29/38 |
| JP | 2009-042276 | | 2/2009 | |
| JP | 4340039 | | 7/2009 | |

* cited by examiner

IMAGE FORMING APPARATUS WITH LOCKING DRAWER UNIT

CROSS-REFERENCE TO RELATED APPLICATION

The present application claims priority to and incorporates by reference the entire contents of Japanese Patent Application No. 2012-272773 filed in Japan on Dec. 13, 2012.

BACKGROUND OF THE INVENTION

1. Field of the Invention

The present invention relates to an image forming apparatus such as a printer, a facsimile, and a copier.

2. Description of the Related Art

In general, in an image forming apparatus in which an electrostatic photographic process is used, a sheet of paper which is a recording medium placed in a paper tray of a paper feed unit is conveyed to an image forming unit through a paper feed conveyance path by a paper feed apparatus and a toner image formed by an image forming unit is transferred to the paper. The paper to which the toner image is transferred is conveyed to a fixing unit and the toner image on the paper is fixed. The paper on which the toner image is fixed is conveyed to a paper discharge tray through a paper discharge conveyance path or conveyed to a reverse conveyance path. The paper conveyed to the reverse conveyance path is reversed and conveyed to the image forming unit again and a toner image is transferred to the back surface of the paper.

In such an image forming apparatus, when a paper jam occurs, the paper may be left straddling between the paper tray and the paper feed unit. In the case as described above, if an operator carelessly pulls out the paper tray, a so-called forced paper tearing occurs in which the paper is torn and broken into a part on the side of the paper tray and a part on the side of the paper feed apparatus, so that a problem occurs in which a paper removal operation is difficult to be performed.

An image forming apparatus described in Japanese Laid-Open Patent Application No. 2005-084181 is provided with a paper jam detection sensor for detecting a paper jam and an automatic lock mechanism for locking the paper tray to an apparatus main body and unlocking the lock. The automatic lock mechanism includes a lock claw, a solenoid that moves the lock claw to a lock position during ON state in which power is supplied from a power supply, and a release spring that pulls the lock claw to an unlock position during OFF state in which power is not supplied and the solenoid is in OFF state. The paper tray is provided with a fitting hole into which the lock claw of the automatic lock mechanism fits at the lock position. When the lock claw fits into the fitting hole, the paper tray is locked to the apparatus main body.

In the automatic lock mechanism, normally, power is not supplied to the solenoid from the power supply, so that the solenoid is in the OFF state. Therefore, the lock claw is pulled by the release spring and located at the unlock position, so that the lock claw does not fit into the fitting hole provided in the paper tray. Hence, the paper tray can be pulled out from the apparatus main body. When an occurrence of a paper jam is detected by a paper jam detection means, power is supplied to the solenoid from the power supply to cause the solenoid to be in the ON state, the lock claw is moved to the lock position, and the lock claw is fitted into the fitting hole of the paper tray. Thereby, the paper tray is locked to the apparatus main body at a predetermined position and the paper tray is prevented from being pulled out. The image forming apparatus has a configuration as described above, so that it is possible to prevent the forced paper tearing as described above from occurring.

When an image forming apparatus is provided with a drawer unit such as a paper tray, if the drawer unit protrudes from the apparatus main body by vibration during transportation, vibration caused by an earthquake, and the like, there is a risk that the drawer unit and a user collide with each other and the user is injured. Therefore, it is considered that the drawer unit is put into a state in which the unit is locked to the apparatus main body by the automatic lock mechanism even when no paper jam occurs so that the drawer unit does not protrude from the apparatus main body by vibration or the like.

However, when the image forming apparatus is transported or when the image forming apparatus is not used for a long time, normally, the power supply of the apparatus is turned off. Therefore, if the power supply of the apparatus is in an OFF state due to transportation or the like, the solenoid is in the OFF state in the automatic lock mechanism and the lock claw is pulled by the release spring to be located at the unlock position, so that the drawer unit is not locked by the automatic lock mechanism. Hence, when the power supply of the apparatus is in an OFF state due to transportation or the like, it is not possible to prevent the drawer unit from being protruded from the apparatus main body by vibration or the like.

On the other hand, as the automatic lock mechanism, it is considered that a lock claw that can move between the lock position and the unlock position by being driven by a drive means to which power is supplied from the power supply is provided. The drawer unit is locked by the automatic lock mechanism in a state in which the power supply of the apparatus is turned on in advance, so that even if the power supply of the apparatus is turned off thereafter, the lock by the automatic lock mechanism is maintained and it is possible to prevent the drawer unit from protruding from the apparatus main body by vibration or the like.

However, in the automatic lock mechanism having a configuration as described above, when the power supply of the apparatus is OFF, the lock claw cannot be driven by the drive means and the lock by the automatic lock mechanism cannot be unlocked, so that the drawer unit cannot be pulled out. Therefore, when the drawer unit is pulled out and maintenance is performed in a state in which the power supply is OFF, it requires a certain amount of time since it is necessary to perform an operation to unlock the automatic lock mechanism after turning on the power supply of the apparatus. Thus, there is a problem that workability is degraded.

Therefore, there is a need to provide an image forming apparatus that can pull out the drawer unit even when the power supply is OFF while preventing the drawer unit from protruding by vibration or the like.

SUMMARY OF THE INVENTION

It is an object of the present invention to at least partially solve the problem in the conventional technology.

According to an embodiment, there is provided an image forming apparatus that includes an image forming unit configured to form an image; a drawer unit configured to be pulled out from a body of the image forming apparatus; a first lock unit configured to receive power from a power supply and perform at least one of lock and unlock of the drawer unit with respect to the body; and a second lock unit configured to perform lock and unlock of the drawer unit with respect to the body by a mechanical operation performed by an operator.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First, an image forming apparatus 1 according to an embodiment of the present invention will be described with reference to FIG. 2. In the present embodiment, the image forming apparatus 1 is a tandem-type color copying machine.

Figure 2:
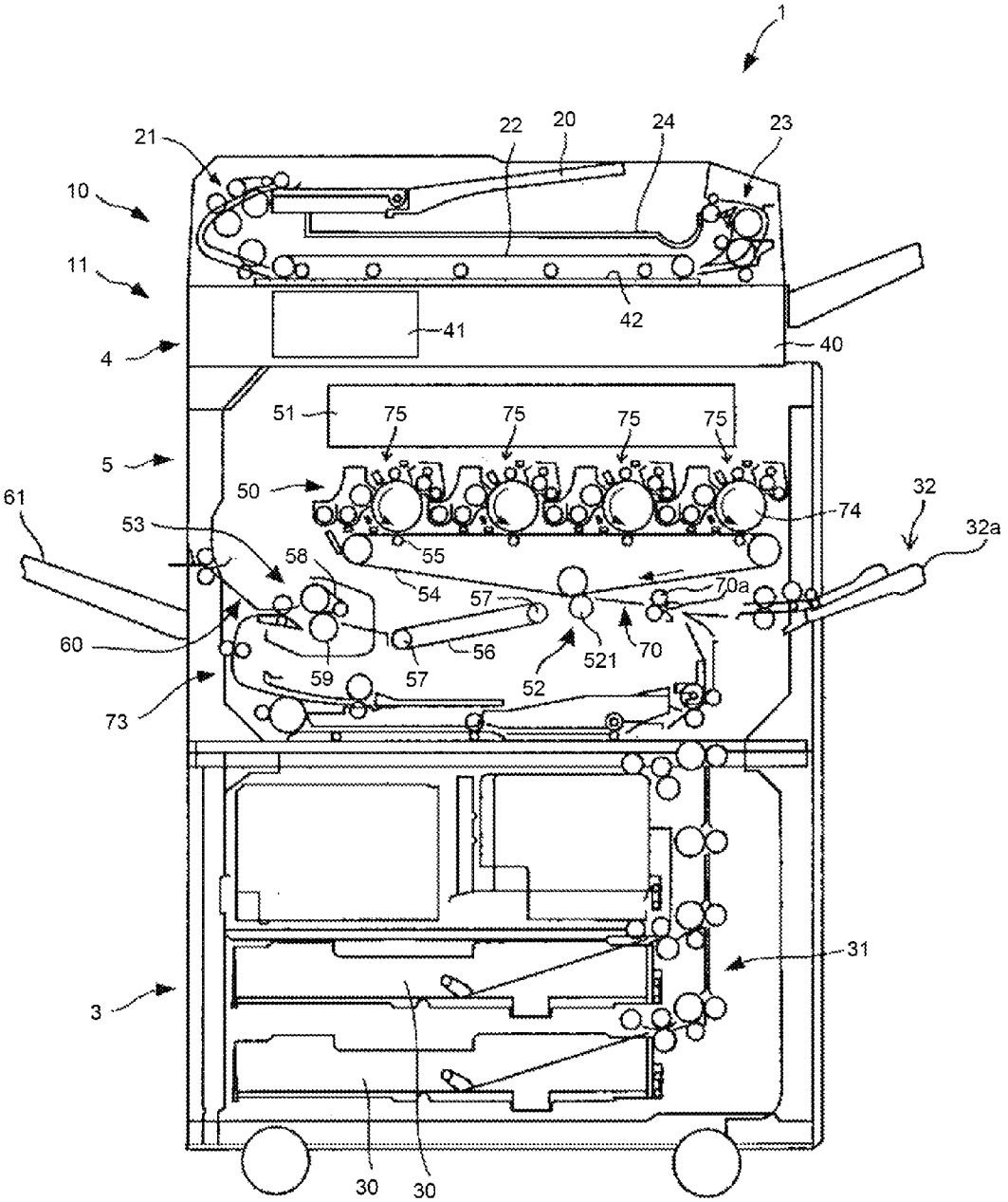
FIG. 2 is a schematic configuration diagram of an image forming apparatus according to an embodiment.

As illustrated in FIG. 2, the image forming apparatus 1 includes an automatic document feeder (hereinafter referred to as ADF) 2 and an image forming apparatus main body 11. The image forming apparatus main body 11 includes a paper feed unit 3, an image reading unit 4, and an apparatus main body unit 5.

The ADF 2 includes a document tray 20, a document feed roller 21, a document conveying belt 22, a document discharge roller 23, and a document discharge tray 24. The ADF 2 is attached operable and closable to the image reading unit 4 through an opening/closing mechanism (not illustrated) such as a hinge.

The document feed roller 21 separates documents one by one from a document bundle (not illustrated in FIG. 2) placed on the document tray 20 and conveys the document to the image reading unit 4. The document conveying belt 22 conveys the document separated by the document feed roller 21 to the image reading unit 4. The document discharge roller 23 discharges the document discharged from the image reading unit 4 by the document conveying belt 22 to the document discharge tray 24 below the document tray 20.

The image reading unit 4 includes a housing 40, a scanning optical unit 41, a contact glass 42, and a drive means (not illustrated in FIG. 2).

The scanning optical unit 41 is provided in the housing 40 and includes an LED unit (not illustrated in FIG. 2). The scanning optical unit 41 emits light from the LED unit in the main scanning direction and is scanned in the sub-scanning direction in an entire irradiation area by the drive means. Thereby, the scanning optical unit 41 reads a two-dimensional color image of the document.

The contact glass 42 is provided above the housing 40 of the image reading unit 4 and forms an upper surface portion of the housing 40. The drive unit includes a wire (not illustrated in FIG. 2) fixed to the scanning optical unit 41, a plurality of driven pulleys (not illustrated in FIG. 2) and a driving pulley (not illustrated in FIG. 2) which are bridged to the wire, and a motor that rotates the driving pulley.

The paper feed unit 3 includes paper feed cassettes 30 and a paper feed apparatus 31. The paper feed cassettes 30 contain pieces of paper (not illustrated in FIG. 2) as recording media whose paper sizes are different. The paper feed apparatus 31 conveys the paper contained in the paper feed cassettes 30 to a main conveyance path 70 of the apparatus main body unit 5.

A manual feed unit 32 for manually feeding pieces of paper is provided to a side surface of the apparatus main body unit 5, a manual feed tray 32*a* is openably and closably provided to the apparatus main body unit 5, and a bundle of paper is manually fed on an upper surface of the tray in a state in which the manual feed tray 32*a* is open with respect to the apparatus main body unit 5. The uppermost piece of paper of the bundle of paper fed manually is sent to the main conveyance path 70 by a sending roller of the manual feed unit 32.

A registration roller pair 70*a* is arranged in the main conveyance path 70. The registration roller pair 70*a* sandwiches the paper conveyed in the main conveyance path 70 between the rollers and thereafter sends the paper to a secondary transfer nip at a predetermined timing.

The apparatus main body unit 5 includes an exposure unit 51, a tandem image forming apparatus 50, an intermediate transfer belt 54, a primary transfer rollers 55Y, C, M, and Bk, a secondary transfer apparatus 52, a fixing apparatus 53, and the like. The apparatus main body unit 5 also includes the main conveyance path 70, a reverse conveyance path 73, a paper discharge path 60, and the like.

As illustrated in FIG. 2, the exposure unit 51 is arranged above the tandem image forming apparatus 50. The exposure unit 51 exposes a photoreceptor drum 74 provided for each color.

The tandem image forming apparatus 50 is arranged above the intermediate transfer belt 54 and includes four image forming units 75Y, C, M, and Bk of yellow (Y), cyan (C), magenta (M), and black (Bk) along a rotation direction of the intermediate transfer belt 54. Although not illustrated in detail, each of the image forming units 75Y, C, M, and Bk includes a charging apparatus, a developing apparatus, a photoreceptor cleaning apparatus, a charge neutralization apparatus, and the like around the photoreceptor drum 74 provided for each color. The photoreceptor drums 74Y, C, M, and Bk and the above apparatuses provided around each photoreceptor drum 74 are unitized and formed into one process cartridge.

In the tandem image forming apparatus 50, a toner image formed by toner is formed on each photoreceptor drum 74Y, C, M, and Bk for each color respectively on the basis of image information which is read and divided into colors by the image reading unit 4. The toner images formed on the photoreceptor drums 74Y, C, M, and Bk are transferred to the intermediate transfer belt 54 between the photoreceptor drums 74Y, C, M, and Bk and the primary transfer rollers 55Y, C, M, and Bk.

On the other hand, the secondary transfer apparatus 52 is provided on the opposite side of the tandem image forming apparatus 50 across the intermediate transfer belt 54. The secondary transfer apparatus 52 includes a paper conveying belt 56 which is rotatably stretched on a secondary transfer roller 521 functioning as a transfer member and a stretching roller 57. The secondary transfer nip is formed by pressing the secondary transfer roller 521 against the intermediate transfer belt 54 through the paper conveying belt 56. At this secondary transfer nip, the toner image formed on the intermediate transfer belt 54 is transferred to the paper conveyed from the paper feed unit 3 through the main conveyance path 70. The paper to which the toner image is transferred at the secondary transfer nip is sent to the fixing apparatus 53 by the paper conveying belt 56.

The fixing apparatus 53 is formed by pressing a pressure roller 59 against a fixing belt 58 which is an endless belt. The fixing apparatus 53 fuses the toner of the toner image transferred to the paper and fixes the toner to the paper as a color image by applying heat and pressure to the paper by the pressure roller 59. The paper on which the color image is fixed in this way is stacked on the paper discharge tray 61 outside the apparatus through the paper discharge path 60 which is a paper discharge conveyance path.

As illustrated in FIG. 2, the reverse conveyance path 73 is provided below the secondary transfer apparatus 52 and the fixing apparatus 53. The reverse conveyance path 73 turns upside down the paper discharged from the fixing apparatus 53 and supplies again the paper to the secondary transfer apparatus 52 through the main conveyance path 70 in order to form an image on both sides of the paper.

In the main conveyance path 70 and the reverse conveyance path 73, a plurality of paper detection sensors (not illustrated in FIG. 2), which is a plurality of paper jam detection means, is arranged along the conveyance paths. The number and the arrangement positions of the paper detection sensors are appropriately set. If each of the paper detection sensors does not detect passing of the paper during a predetermined period of time, the paper detection sensor detects that a paper jam has occurred and notifies a display unit of the image forming apparatus 1 or the like (not illustrated in FIG. 2) that the paper jam has occurred.

The image forming apparatus 1 of the present embodiment further includes a drawer unit 76 which holds the secondary transfer apparatus 52, the fixing apparatus 53, the main conveyance path 70, the paper discharge path 60, and the reverse conveyance path 73 illustrated in FIG. 2 and which is formed to be drawable from the apparatus main body unit 5.

Figure 3:
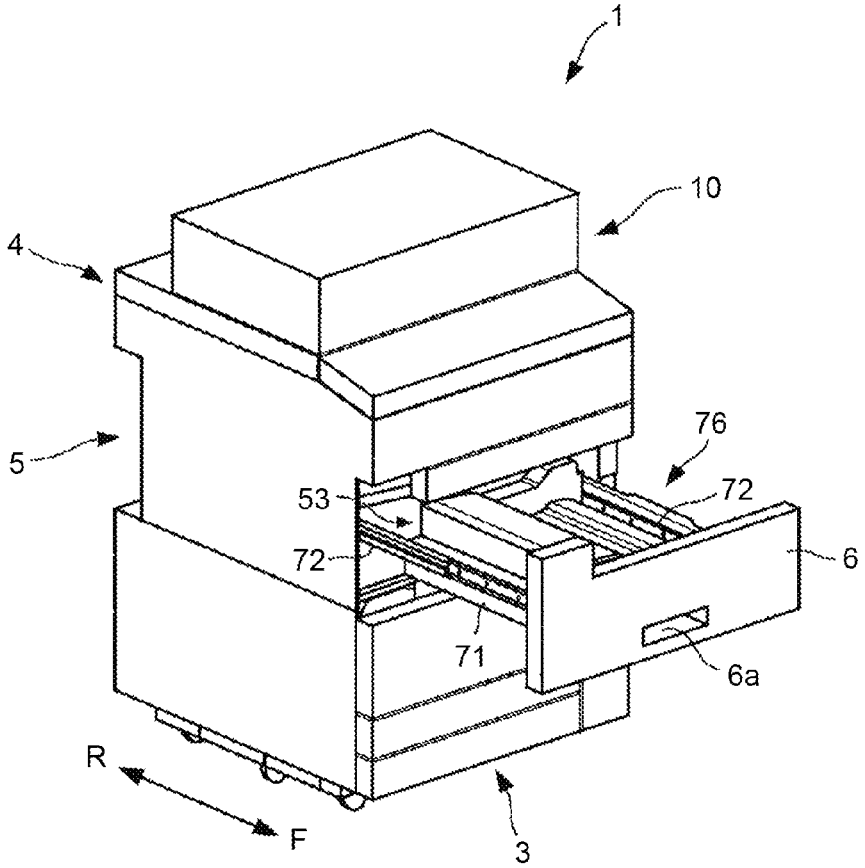
FIG. 3 is a perspective view of the image forming apparatus.

FIG. 3 is a perspective view of the image forming apparatus 1.

The drawer unit 76 includes a carrier 71 that holds the secondary transfer apparatus 52, the fixing apparatus 53, the main conveyance path 70, and the reverse conveyance path 73. A front cover 6 is attached to the carrier 71. The carrier 71 is supported by a rail 72 provided in the apparatus main body so that the carrier 71 can be moved in the front-back direction (arrow FR in FIG. 3) with respect to the apparatus main body unit 5. When a user grips a handle portion 6*a* provided in the front cover 6 and moves the front cover 6 in the front-back direction (arrow FR in FIG. 3) with respect to the apparatus main body unit 5, the user can pull out the drawer unit 76 from the apparatus main body unit 5 and insert the drawer unit 76 into the apparatus main body unit 5.

In the present specification, the front side F of the image forming apparatus 1 means the near side of the image forming apparatus 1 and the rear side R of the image forming apparatus 1 means the far side of the image forming apparatus 1.

When the image forming apparatus 1 is used, the drawer unit 76 is inserted into the apparatus main body unit 5. On the other hand, when replacing each apparatus held by the drawer unit 76 or removing paper jammed in each conveyance path, the drawer unit 76 is pulled out from the apparatus main body unit 5 toward the front side F. Thereby, it is possible to replace each apparatus held by the drawer unit 76 and remove paper jammed in each conveyance path.

Figure 4:
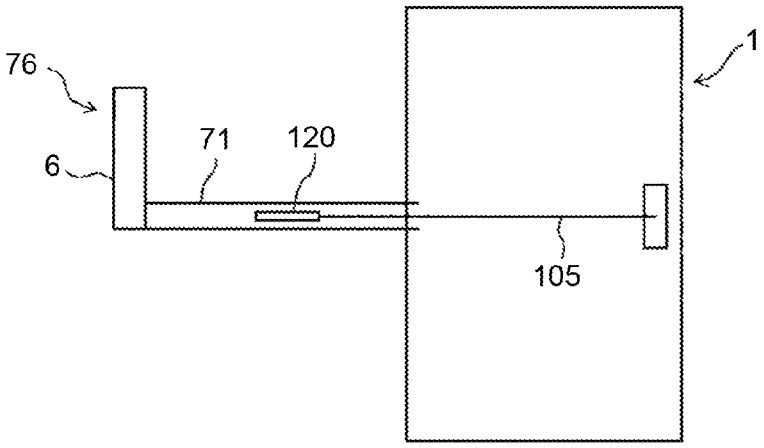
FIG. 4 is a schematic diagram when a drawer unit is pulled out.

FIG. 4 is a schematic diagram when the drawer unit 76 is pulled out. In FIG. 4, illustrations of the secondary transfer apparatus 52, the fixing apparatus 53, the main conveyance path 70, and the reverse conveyance path 73 held by the carrier 71 are omitted. Also in the drawer unit 76 illustrated below, the secondary transfer apparatus 52, the fixing apparatus 53, the main conveyance path 70, and the reverse conveyance path 73 held by the carrier 71 are appropriately omitted.

As illustrated in FIG. 4, an electrical substrate 120 is arranged in the drawer unit 76. The electrical substrate 120 includes a CPU, a ROM, and the like. The ROM stores a control program and the like for performing control of the secondary transfer apparatus 52, control of the fixing apparatus 53, paper conveyance control in the main conveyance path 70, paper conveyance control in the reverse conveyance path 73, paper jam detection control, and the like.

In the present embodiment, as illustrated in FIG. 4, even when the drawer unit 76 is pulled out, the electrical substrate 120 and the apparatus main body are connected by using a bundle wire 105, which is electrical wires, so that an electrical connection is maintained. In this way, the electrical substrate 120 that performs control of the apparatuses held by the carrier 71 is arranged in the drawer unit 76, so that a bundle wire required for the connection may be only one bundle wire 105 that connects the electrical substrate 120 and the apparatus main body. Therefore, it is easy to secure a bundle wire path.

Figure 5:
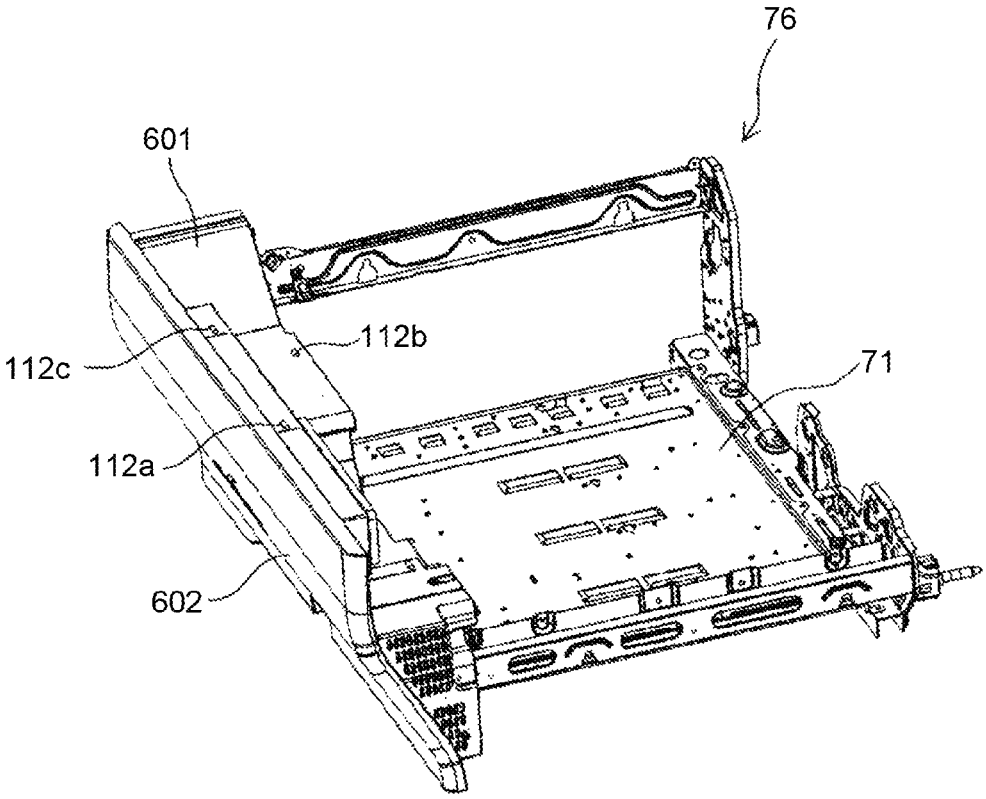
FIG. 5 is a perspective view of the drawer unit.

FIG. 5 is a perspective view of the drawer unit 76.

As illustrated in FIG. 5, the front cover 6 includes an outer cover unit 602 that is exposed from the apparatus even when the drawer unit 76 is closed in the apparatus main body and an inner cover unit 601 that is exposed when the drawer unit 76 is pulled out from the apparatus main body unit 5. A plurality of drawer unit LEDs 112*a* to 112*c*, which are notification means that notify a position at which a paper jam occurs, are provided on the upper surface of the inner cover unit 601.

When a paper jam is detected in the secondary transfer apparatus 52, the fixing apparatus 53, the main conveyance path 70, the paper discharge path 60, or the reverse conveyance path 73 held by the drawer unit 76, the drawer unit LEDs 112*a* to 112*c* corresponding to a position at which the paper jam is detected emit light.

In the present embodiment, as illustrated in FIG. 5, even when the drawer unit 76 is pulled out from the apparatus main body, the drawer unit 76 is electrically connected by the bundle wire 105. Therefore, even when the drawer unit 76 is pulled out for paper jam processing, it is possible to light the drawer unit LEDs 112*a* to 112*c* corresponding to a position at which the paper jam occurs.

Each of the drawer unit LEDs 112*a* to 112*c* is arranged at a position corresponding to a position at which the paper jam occurs. For example, the first drawer unit LED 112*a* is provided at a position corresponding to an operation member (not illustrated in the drawings) operated when removing paper jammed in a conveyance path from the paper feed unit 3 to the secondary transfer nip in the drawer unit 76. The second drawer unit LED 112*b* is provided at a position corresponding to an operation member (not illustrated in the drawings) operated when removing paper jammed in a conveyance path from the secondary transfer nip to the fixing apparatus 53. The third drawer unit LED 112*c* is provided at a position corresponding to an operation member (not illustrated in the drawings) operated when removing paper jammed in a conveyance path 60 from the fixing apparatus 53 to the paper discharge tray 61.

Although not illustrated in the drawings, a drawer unit LED is also provided at a position corresponding to an operation member (not illustrated in the drawings) which is provided on the front surface of the outer cover unit 602 which is operated when removing paper jammed in the reverse conveyance path 73.

Figure 6:
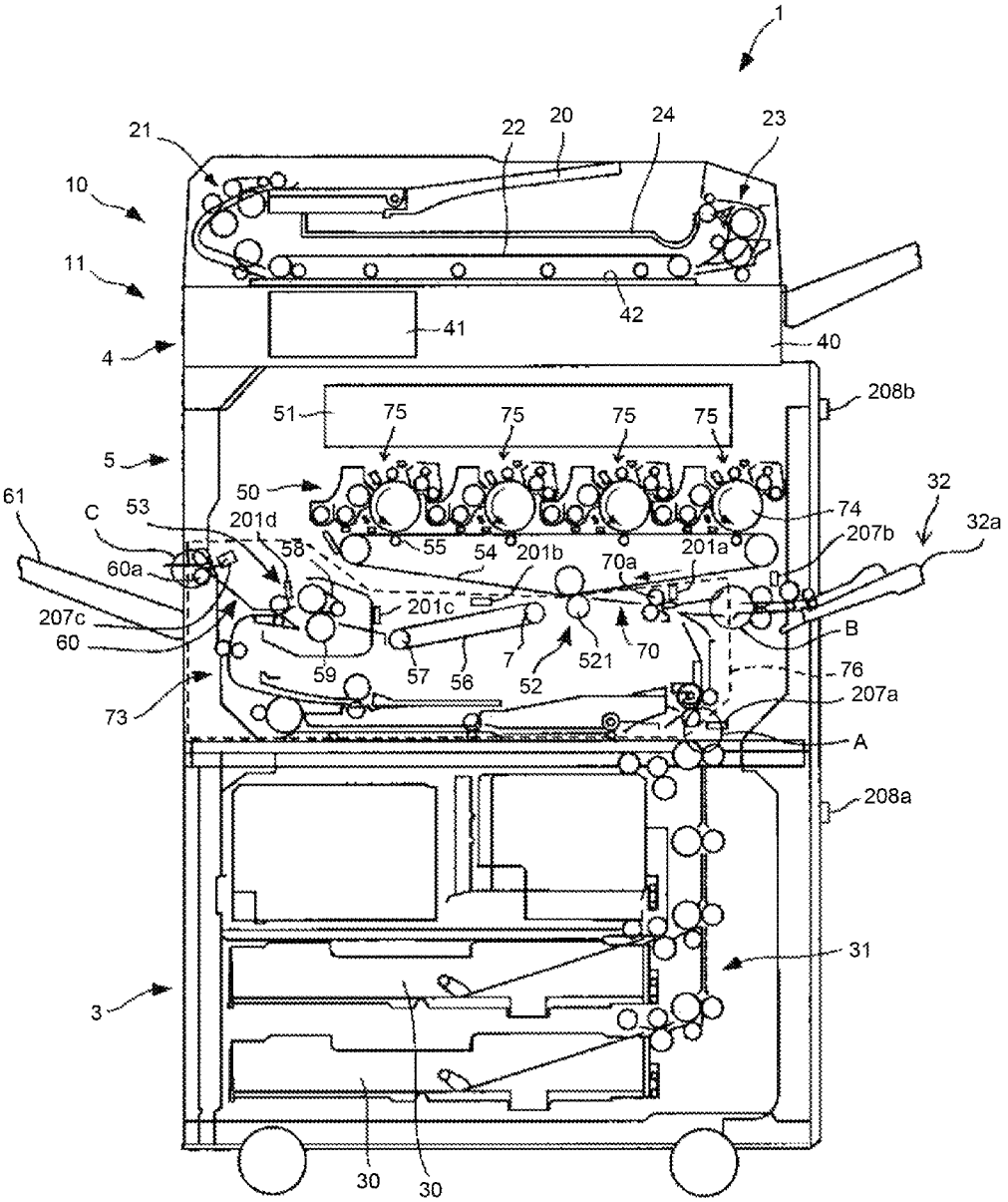
FIG. 6 is a diagram illustrating an example of arrangement positions of paper detection sensors.

FIG. 6 is a diagram illustrating an example of arrangement positions of the paper detection sensors which are the paper jam detection means. As illustrated in FIG. 6, there are a pre-secondary transfer paper detection sensor 201*a* that detects paper passing through the registration roller pair 70*a* and a post-secondary transfer paper detection sensor 201*b* that detects paper passing through the paper conveying belt 56. Further, there are a pre-fixing paper detection sensor 201*c* which is arranged before the fixing apparatus 53 and detects paper that is being conveyed to the fixing apparatus 53 and a post-fixing paper detection sensor 201*d* which is arranged after the fixing apparatus 53 and detects paper that has passed through the fixing apparatus 53.

For example, when a paper jam occurs, if the pre-secondary transfer paper detection sensor 201*a* detects paper, the first drawer unit LED 112*a* is lighted. When a paper jam occurs, if the post-secondary transfer paper detection sensor 201*b* or the pre-fixing paper detection sensor 201*c* detects paper, the second drawer unit LED 112*b* is lighted. When a paper jam occurs, if the post-fixing paper detection sensor 201*d* detects paper, the third drawer unit LED 112*c* is lighted.

Thereby, the user can easily understand which operation member should be operated to perform paper jam processing from the lighted drawer unit LED, so that the user can perform appropriate paper jam processing. When the user removes the jammed paper and the paper detection sensor does not detect the paper, a corresponding drawer unit LED is unlighted. Then, if the user visually checks that all of the drawer unit LEDs are unlighted, the user returns the drawer unit 76 into the apparatus main body and completes the paper jam processing. Thereby, it is possible to prevent the user from forgetting to perform the paper jam processing.

It is preferable that the drawer unit 76 be pulled out by a length longer than the length of the drawer unit in the pulling out direction of the apparatus main body. By the configuration described above, the secondary transfer apparatus 52, the fixing apparatus 53, the main conveyance path 70, the paper discharge path 60, and the reverse conveyance path 73 that are held by the drawer unit 76 can be completely pulled out from the apparatus main body. Thereby, it is possible to easily perform the paper jam processing.

Regarding the arrangement of the drawer unit LEDs 112*a* to 112*c* which are notification means, it is desirable that the drawer unit LEDs 112*a* to 112*c* are arranged at positions that can be easily seen from the front in a state in which the drawer unit 76 is opened. In the present embodiment, the drawer unit LEDs 112*a* to 112*c* are arranged on the upper surface of the inner cover unit 601 of the front cover 6, which is considered to be easily checked visually when the drawer unit 76 is pulled out from the apparatus main body.

When a paper jam occurs and conveyance of the paper stops, the paper may stop while straddling between a conveyance path of the drawer unit 76 and a conveyance path of other than the drawer unit. In the present embodiment, as illustrated in FIG. 6, there is a paper feed path straddling portion A where paper straddles when the paper is conveyed from the paper feed unit 3 to the drawer unit 76. Further, there is a manual feed path straddling portion B where paper straddles when the paper is conveyed from the manual feed tray 32*a* to the drawer unit 76. Further, there is a paper discharge path straddling portion C where paper straddles when the paper is discharged from the drawer unit 76 to the paper discharge tray 61.

Figure 7:
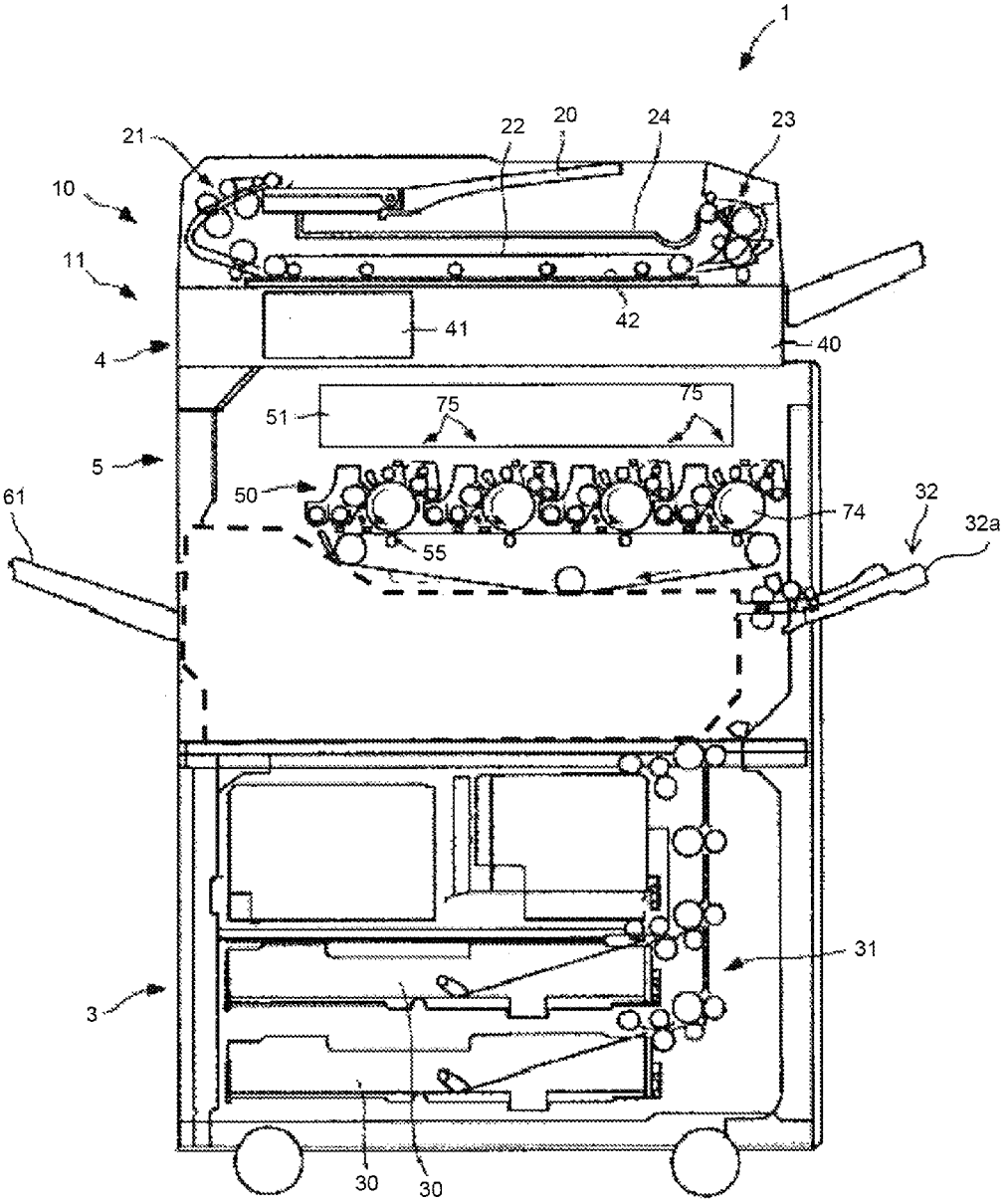
FIG. 7 is a schematic configuration diagram of the image forming apparatus in a state in which the drawer unit is pulled out.

FIG. 7 is a schematic configuration diagram of the image forming apparatus 1 when the drawer unit 76 is pulled out. As illustrated in FIG. 7, when the drawer unit 76 is pulled out, the paper feed unit 3, the manual feed tray 32*a*, and the paper discharge tray 61 are located on the side of the apparatus main body.

In the paper jam processing, if the drawer unit 76 is pulled out in a state in which paper straddles over one of the straddling portions, a portion of the paper located on the side of the drawer unit is crumpled and approaches the side of the apparatus main body unit. On the other hand, a portion of the paper located on the side of the apparatus main body unit 5 or the paper feed unit 3 is crumpled and approaches the direction of the drawer unit 76. Thereafter, when the drawer unit 76 is completely pulled out from the apparatus main body, a so-called forced paper tearing occurs in which the paper is torn apart.

The paper which is located on the side of the drawer unit 76 pulled out from the apparatus main body unit 5 and which approaches the apparatus main body unit and is torn apart enters gaps in the drawer unit 76 on the side of the apparatus main body in a complicated manner. Therefore, it is difficult to perform a removing operation of the paper. In the same manner, the paper which is located on the side of the apparatus main body unit 5 or the paper feed unit 3 and which approaches the drawer unit and is torn apart enters gaps in the apparatus main body unit 5 or the paper feed unit 3 on the side of the drawer unit direction in a complicated manner. Therefore, it is difficult to perform a removing operation of the paper.

When forcibly removing the paper which is crumpled in one direction in the drawer unit 76, the apparatus main body unit 5, or the paper feed unit 3 and enters gaps in a complicated manner, the paper is torn apart and a piece of paper may remain in the drawer unit 76 and the apparatus main body unit 5 (the paper feed unit 3). As a result, there is a risk that the piece of paper is jammed in conveying rollers provided in the drawer unit 76 or conveying rollers provided in the apparatus main body unit 5 or the paper feed unit 3 and a conveyance error occurs. If the piece of paper stops at a paper detection sensor provided in the drawer unit 76 or the like, there is a risk that a paper jam cannot be detected properly.

Therefore, in the present embodiment, in the jam processing, when paper straddles over one of the straddling portions, the drawer unit 76 cannot be pulled out from the apparatus main body, and when paper straddling over the straddling portion is removed, the drawer unit 76 can be pulled out from the apparatus main body.

As illustrated in FIG. 6, in the present embodiment, a paper feed conveyance sensor 207*a*, which is a straddling detection means that detects paper straddling over the paper feed path straddling portion A, is provided near the paper feed path straddling portion A. Further, a manual paper feed sensor 207*b*, which is a straddling detection means that detects paper straddling over the manual feed path straddling portion B, is provided near the manual feed path straddling portion B. Further, a paper discharge sensor 207*c*, which is a straddling detection means that detects paper straddling over the paper discharge path straddling portion C, is provided near the paper discharge path straddling portion C. The paper feed conveyance sensor 207*a* and the manual paper feed sensor 207*b* are installed in the apparatus main body unit 5 and the paper discharge sensor 207*c* is installed in the drawer unit 76.

In the description below, when the paper feed conveyance sensor 207*a*, the manual paper feed sensor 207*b*, and the paper discharge sensor 207*c*, which detect the straddling of paper, are not distinguished from one another, they are collectively referred to as a straddle sensor 207. When the straddle sensor 207 detects a paper jam, the drawer unit 76 is locked to the apparatus main body by a lock mechanism described later.

As illustrated in FIG. 6, an upper right cover LED 208*b*, which is a notification means, is provided on the right cover member of the apparatus main body unit 5. Further, a lower right cover LED 208*a* is provided on the right cover member of the paper feed unit 3. The cover LEDs 208*a* and 208*b* are also LEDs for notifying a user of which portion should be operated when the user performs the paper jam processing.

Figure 8A:
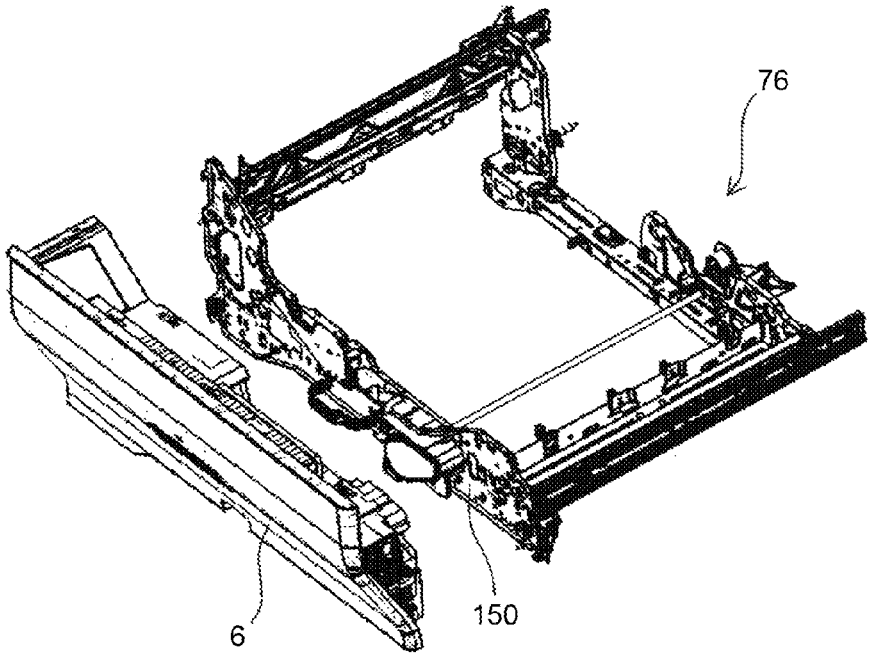
FIG. 8A is an exploded perspective view of a carrier of the drawer unit and the front cover.
Figure 8B:
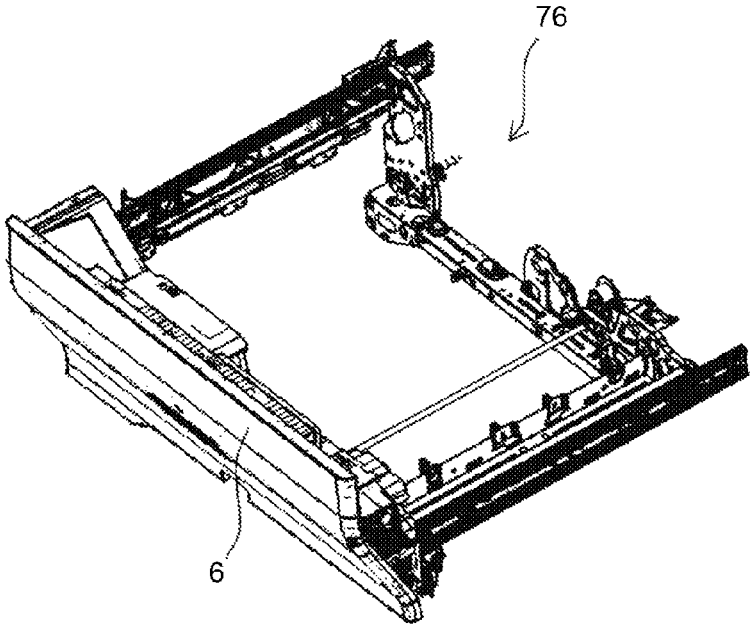
FIG. 8B is a perspective view of the front cover fixed to the carrier of the drawer unit.

FIG. 8A is an exploded perspective view of the carrier 71 of the drawer unit 76 and the front cover 6. FIG. 8B is a perspective view of the front cover 6 fixed to the carrier 71 of the drawer unit 76.

The front cover 6 is fixed to a drawer unit front plate 150 by screws and cannot be removed without using a tool. In this way, in the present embodiment, the front cover 6 is fixed to the drawer unit 76, so that the drawer unit 76 can be pulled out by only pulling out the front cover 6. Thereby, the operation to pull out the drawing unit 76 can be performed by one action, so that it is possible to improve work efficiency of the paper jam processing as compared with the configuration in which the drawer unit 76 is pulled out by opening/closing the front cover 6.

Figure 10:
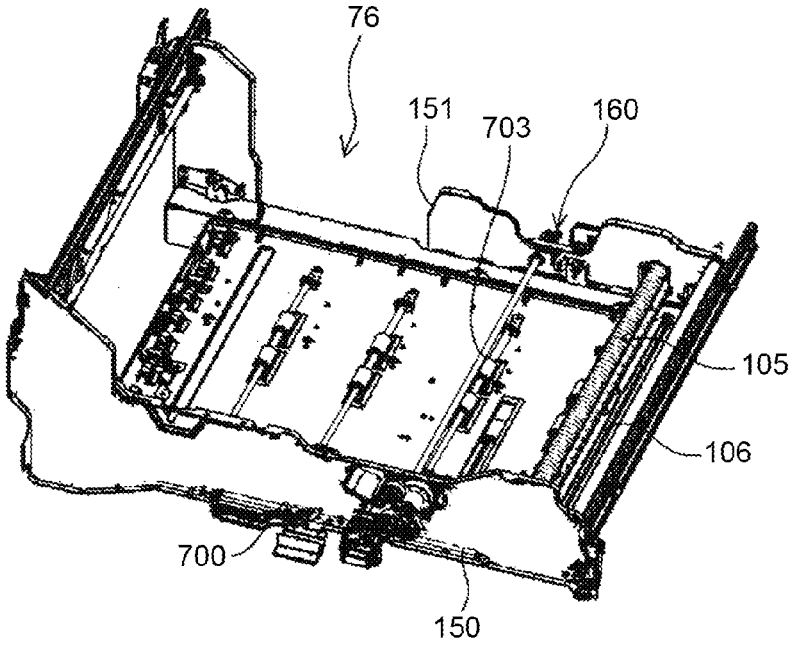
FIG. 10 is a perspective view of the drawer unit from which the front cover is removed.

FIG. 10 is a perspective view of the drawer unit 76 from which the front cover 6 is removed.

FIG. 10 illustrates a state in which the drawer unit 76 is stored in the apparatus main body unit 5.

As illustrated in FIG. 10, the bundle wire 105 is arranged at a right end portion of the drawer unit 76 in FIG. 10 (at an end portion on the side of the main conveyance path 70) and the bundle wire 105 is held by a cord guide 130.

The bundle wire 105 is a so-called curl cord, which is a spirally wound cord. The curl code is used as the bundle wire 105, so that the bundle wire 105 can expand and contract in the drawing direction. Thereby, it is possible to suppress sagging of the bundle wire 105 as compared with a case in which a cord that does not expand and contract is used as the bundle wire 105. Therefore, as seen from the drawing direction of the drawer unit 76, it is possible to prevent the bundle wire 105 from running off from the drawer unit 76 and sagging, so that it is possible to prevent the bundle wire 105 from being caught in components in the apparatus main body.

The cord guide 130 is attached to a main body rear plate 501 (see FIG. 16) of the apparatus main body unit 5 described later. As illustrated in FIG. 10, when the drawer unit 76 is stored in the apparatus main body unit 5, the cord guide 130 is stored in the drawer unit 76. When the drawer unit 76 is pulled out from the apparatus main body, the cord guide 130 is pulled out from the drawer unit 76 along with the bundle wire 105 relatively from a drawer unit rear plate 151. Thereby, the bundle wire 105 relatively pulled out from the drawer unit 76 is guided by the cord guide 130, so that it is possible to prevent the bundle wire 105 from sagging (see FIG. 16).

A lock shaft 703 is rotatably supported by the drawer unit front plate 150 and the drawer unit rear plate 151. An electrical lock mechanism 160, which is a lock means, is provided at the rear end portion of the lock shaft 703.

Figure 11:
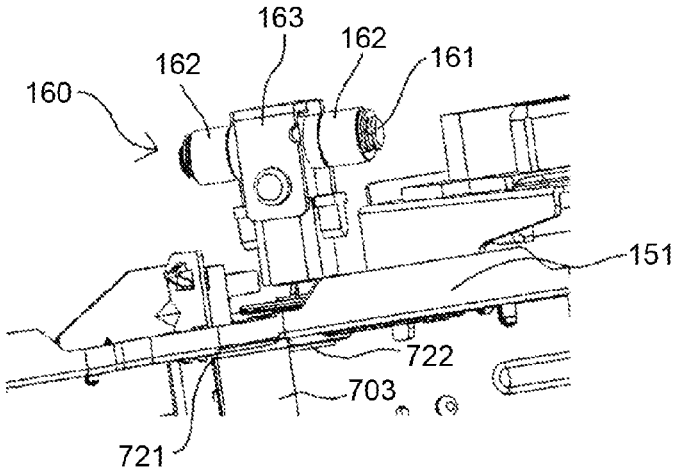
FIG. 11 is a perspective view illustrating a lock mechanism.

FIG. 11 is a perspective view illustrating a configuration of the electrical lock mechanism 160. As illustrated in FIG. 11, the rear end portion of the lock shaft 703 protrudes from the drawer unit rear plate 151 and the electrical lock mechanism 160 is attached to the rear end portion. The electrical lock mechanism 160 has a prism-shaped fitting member 163 fixed to the lock shaft 703.

Further, the electrical lock mechanism 160 has a roller shaft 161 which is fixed to the fitting member 163 so that the roller shaft 161 penetrates the fitting member 163 in a direction perpendicular to the axis direction of the lock shaft 703. The electrical lock mechanism 160 has rotating rollers 162 rotatably attached to the roller shaft 161 near both ends of the roller shaft 161.

As illustrated in FIG. 11, the lock shaft 703 is attached to the drawer unit rear plate 151 through a sintered bearing 721. Further, an E-ring 722 is fixed to a groove provided in the lock shaft 703 so as to be in contact with the front side surface of the drawer unit rear plate 151.

As illustrated in FIG. 10, a drive unit 700 that drives and rotates the electrical lock mechanism 160 through the lock shaft 703 is provided on the drawer unit front plate 150.

Figure 12:
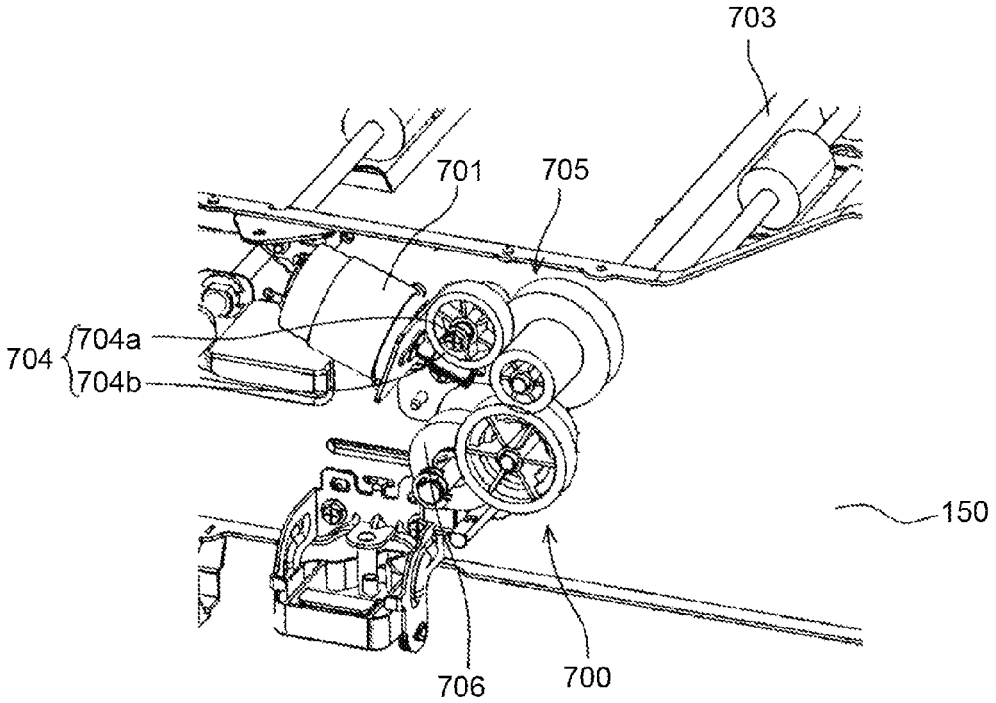
FIG. 12 is a perspective view illustrating a configuration of a drive unit.

FIG. 12 is a perspective view illustrating a configuration of the drive unit 700. As illustrated in FIG. 12, the drive unit 700 includes a drive motor 701. The drive motor 701 is fixed to the drawer unit front plate 150 so that the motor shaft is in parallel with the drawer unit front plate 150. The drive motor 701 is fixed in this way, so that it is possible to prevent the drawer unit 76 from being enlarged in the drawing direction as compared with a case in which the drive motor 701 is fixed so that the motor shaft of the drive motor 701 is perpendicular to the drawer unit front plate 150.

A screw gear 704*a* of a worm gear 704 is fixed to the motor shaft of the drive motor 701. A driving force of the drive motor 701 is transmitted from a helical gear 704*b* of the worm gear 704 engaging with the screw gear 704*a* to a driven gear 706 fixed to the lock shaft 703 through a gear train 705 including a plurality of idler gears and the lock shaft 703 is driven and rotated.

Figure 13:
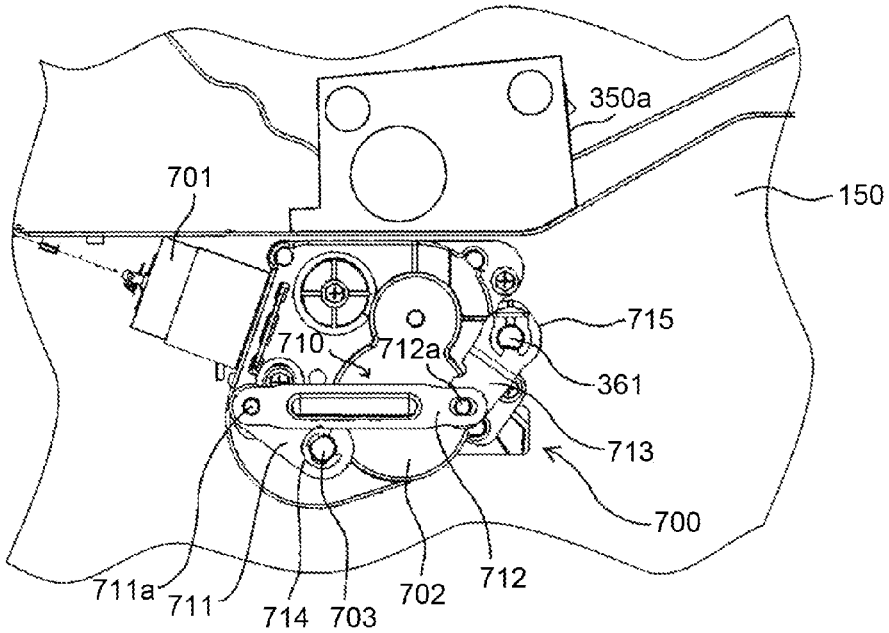
FIG. 13 is a front view of the drive unit.

FIG. 13 is a front view of the drive unit 700.

As illustrated in FIG. 13, the worm gear 704, the plurality of idler gears included in the gear train 705, and the driven gear 706 fixed to the lock shaft 703 are stored in a case 702.

A link mechanism 710 that transmits a drive force to a contacting/separating mechanism that causes the secondary transfer roller 521 described later to be in contact with or separated from the intermediate transfer belt 54 is connected to the front end portion 264*a* of the lock shaft 703.

The link mechanism 710 includes an output link member 711, a linkage link member 712, and an input link member 713. One end of the output link member 711 is fixed to the lock shaft 703 and the other end is provided with an output protrusion portion 711*a*.

The front end portion 264*a* of the lock shaft 703 has a cross-sectional D-shape. A D-shaped fitting hole is formed in one end of the output link member 711 and the D-shaped fitting hole is fitted to the front end portion 264*a* of the lock shaft 703. An E-ring 714 is attached to the lock shaft 703 so that the output link member 711 does not fall from the lock shaft 703. Thereby, the output link member 711 is fixed to the lock shaft 703.

One end of the linkage link member 712 is rotatably attached to the output protrusion portion 711*a* of the output link member 711. A long hole 712*a* is formed in the other end of the linkage link member 712 and an input protrusion portion 713*a* provided in one end of the input link member 713 is fitted into the long hole 712*a*.

An end portion of an input shaft 361 that inputs a drive force to the contacting/separating mechanism described later also has a cross-sectional D-shape and a D-shaped fitting hole formed in the other end of the input link member 713 is fitted to one end of the input shaft 361. An E-ring 714 is attached to the input shaft 361 so that the input link member 713 does not fail from the input shaft 361.

The link mechanism 710 is used to transmit a drive force from the lock shaft 703 to the input shaft 361, so that a plate material can be used as each link member and it is possible to prevent the drawer unit 76 from being enlarged in the drawing direction as compared with a case in which a drive force is transmitted by gears.

Here, the contacting/separating mechanism that causes the secondary transfer roller 521 described later to be in contact with or separated from the intermediate transfer belt 54 will be described. The contacting/separating mechanism is provided at both ends (front and rear) of the secondary transfer roller and has the same configuration.

Figure 14:
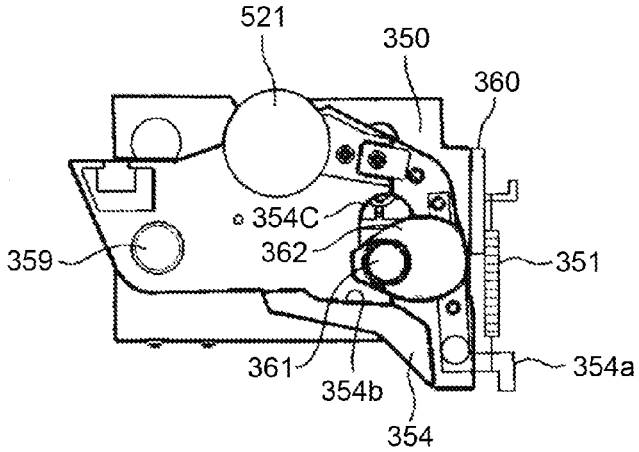
FIG. 14 is a schematic configuration diagram of a secondary transfer roller contacting/separating mechanism.

FIG. 14 is a schematic configuration diagram of the contacting/separating mechanism provided at one end of the secondary transfer roller 521 in the shaft direction.

The secondary transfer roller 521 is rotatably supported by a holding member 354. The holding member 354 is rotatably supported by a support shaft 359 attached to a frame 350 of the secondary transfer apparatus. A spring receiver 354*a* is provided at an end portion of the holding member 354 on the opposite side of the support shaft 359 with the secondary transfer roller 521 in between. One end of a spring 351 is attached to the spring receiver 354*a* and the holding member 354 is urged upward in FIG. 14 (toward the intermediate transfer belt 54) by the spring 351.

A long hole 354*c* is provided in the holding member 354 on the opposite side of the support shaft 359 with the secondary transfer roller 521 in between and the input shaft 361 described above penetrates the long hole 354*c*. A release cam 362 is attached to the input shaft 361. A butting portion 354*b* against which the release cum 362 butts is provided in the holding member 354.

As illustrated in FIG. 14, when the release cum 362 is away from the butting portion 354*b*, the secondary transfer roller 521 is in contact with the intermediate transfer belt 54 by a predetermined pressure by an urging force of the spring 351.

Figure 15:
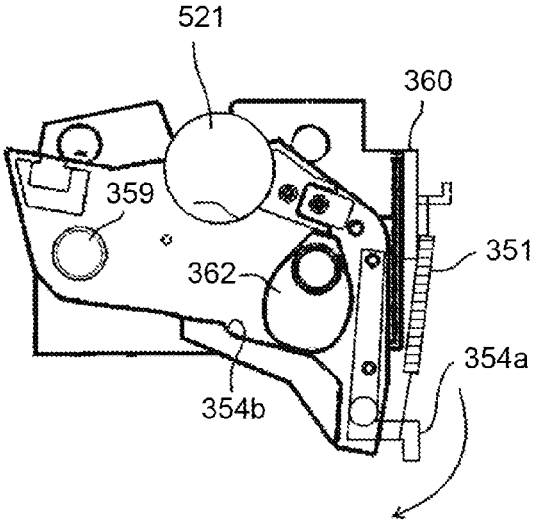
FIG. 15 is a diagram illustrating a state in which a secondary transfer roller is positioned at a separated position.

When pulling out the drawer unit 76, the input shaft 361 is rotated and the release cum 362 rotates clockwise in FIG. 14. Then, the release cum 362 butts against the butting portion 354*b*. When the input shaft 361 rotates further, as illustrated in FIG. 15, the holding member 354 is rotated clockwise in FIG. 14 by the release cum 362 against the urging force of the spring 351 with the support shaft 359 as a fulcrum. Thereby, the secondary transfer roller 521 is separated from the intermediate transfer belt 54. In other words, in the present embodiment, the contacting/separating mechanism that causes the secondary transfer roller 521 to be in contact with or separated from the intermediate transfer belt 54 is formed by the holding member 354, the spring 351, the release cum 362, and the like.

In the present embodiment, the secondary transfer roller 521 moves by about 5 to 7 mm from the pressure position illustrated in FIG. 14 to a retreat position illustrated in FIG. 15.

Figure 16:
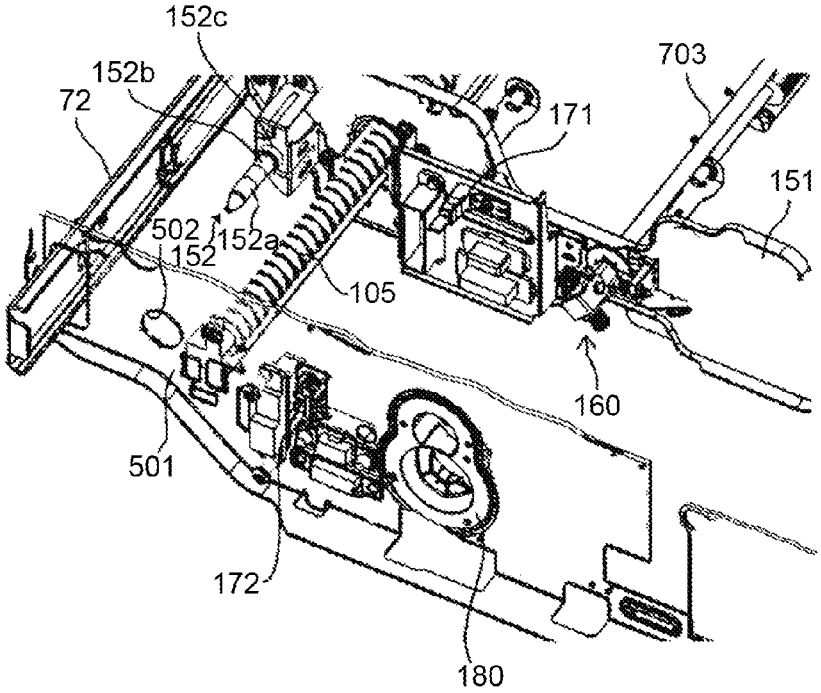
FIG. 16 is a perspective view of a rear portion of an apparatus main body unit in a state in which the drawer unit is pulled out.
Figure 17:
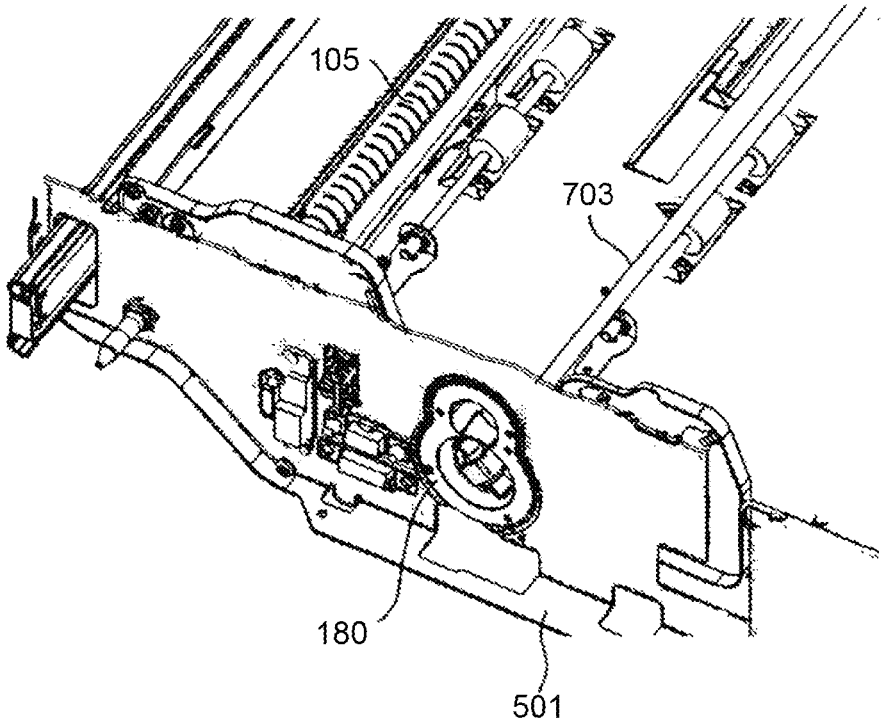
FIG. 17 is a perspective view of the rear portion of the apparatus main body unit in a state in which the drawer unit is set in the apparatus main body.

FIG. 16 is a perspective view of a rear portion of the apparatus main body unit in a state in which the drawer unit 76 is pulled out. FIG. 17 is a perspective view of the rear portion of the apparatus main body in a state in which the drawer unit 76 is set in the apparatus main body unit 5.

A positioning hole 502 into which a positioning pin 152 provided in a left end portion of the drawer unit 76 in FIG. 16 is inserted is provided near a left end portion of the main body rear plate 501 of the apparatus main body unit 5 in FIG. 16. The positioning pin 152 includes a fitting portion 152*b* that fits into the positioning hole 502 and a taper-shaped guide portion 152*a* for guiding the fitting portion 152*b* into the positioning hole. The positioning pin 152 further includes a seating surface portion 152*c* whose diameter is greater than that of the fitting portion 152*b* and which is pressed against the main body rear plate 501 when the drawer unit 76 is locked to the apparatus main body unit 5 by the electrical lock mechanism 160 described later.

A set detection sensor 172 for detecting that the drawer unit 76 is set in the apparatus main body unit 5 is provided on the main body rear plate 501. A set detection filler 171 which is a set-detected unit detected by the set detection sensor 172 is provided on the drawer unit rear plate 151. In summary, in the present embodiment, a set detection mechanism which is a set detection means that detects setting of the drawer unit 76 in the apparatus main body unit 5 is formed by the set detection sensor 172, the set detection filler 171, and the like.

Figure 18:
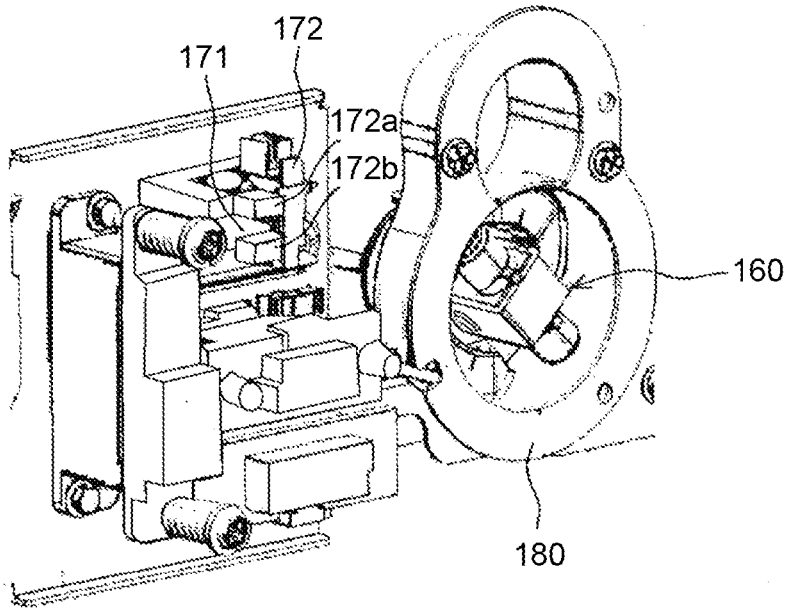
FIG. 18 is an enlarged configuration diagram of a portion around a set detection sensor.

FIG. 18 is an enlarged configuration diagram of a portion around the set detection sensor 172.

As illustrated in FIG. 18, a photo-interrupter (transmission type optical sensor) is used as the set detection sensor 172. When the drawer unit 76 is set in the apparatus main body unit 5, the set detection filler 171 provided on the drawer unit rear plate 151 enters between a light receiving unit 172*b* and a light emitting unit 172*a* of the set detection sensor 172 and blocks light from the light emitting unit 172*a*. Thereby, the light receiving unit 172*b* does not detect the light from the light emitting unit 172*a*, so that it is possible to detect that the drawer unit 76 is set in the apparatus main body unit 5.

As illustrated in FIGS. 16 and 17, a lock receiving member 180 against which the rotating rollers 162 of the electrical lock mechanism 160 are pressed when the drawer unit 76 is locked to the apparatus main body unit 5 is provided.

Figure 19:
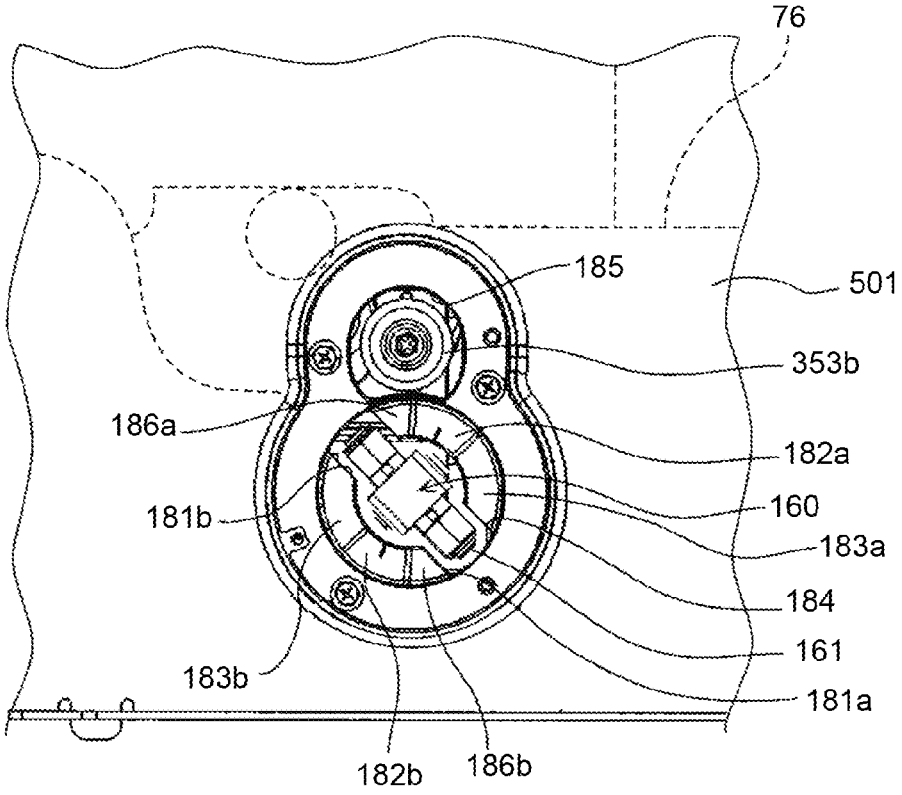
FIG. 19 is an enlarged configuration diagram of a portion around a lock receiving member.
Figure 20:
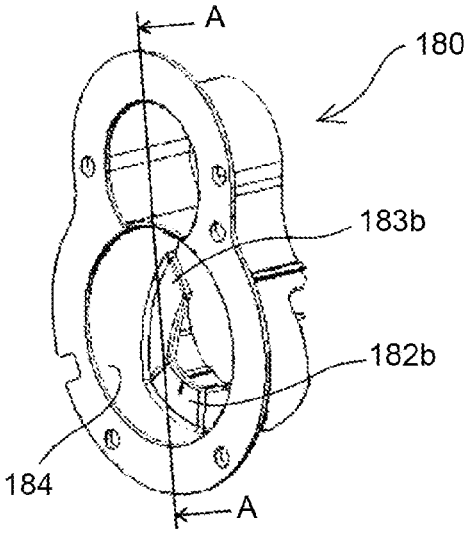
FIG. 20 is a perspective view of the lock receiving member.

FIG. 19 is an enlarged configuration diagram of the lock receiving member 180. FIG. 20 is a perspective view of the lock receiving member 180.

The lock receiving member 180 is provided with a lock through hole 184 into which the electrical lock mechanism 160 is inserted. A secondary transfer through hole 185 into which a joint member 353*b* fixed to the shaft of the secondary transfer roller 521 is inserted is provided above the lock through hole 184. As illustrated in FIG. 20, the secondary transfer through hole 185 and the lock through hole 184 of the lock receiving member 180 have a cylindrical shape.

Figure 21:
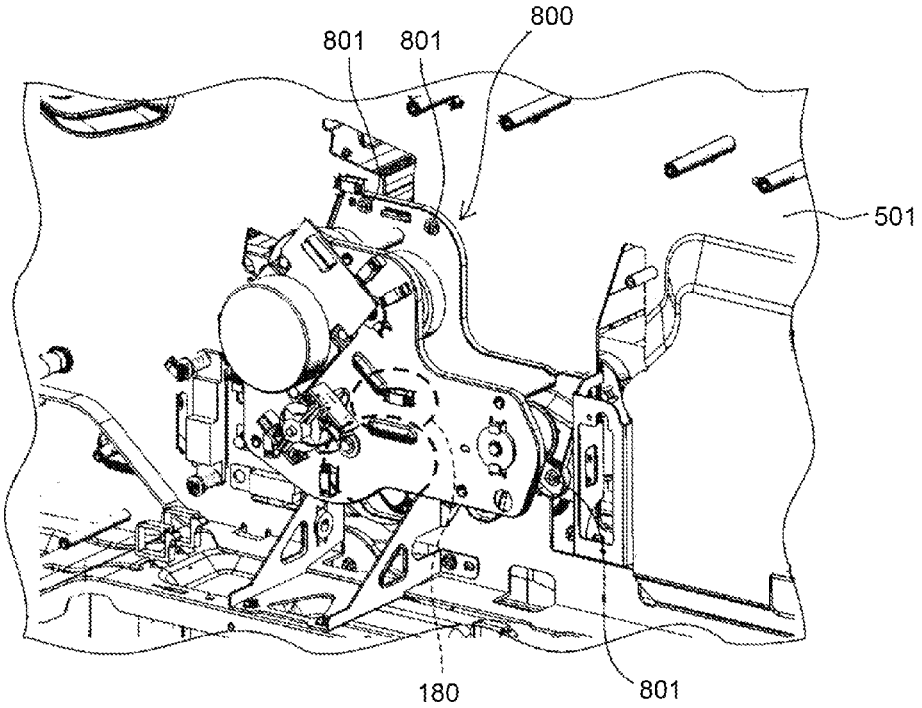
FIG. 21 is a diagram for explaining an arrangement position of a secondary transfer drive unit.

When the drawer unit 76 is set in the apparatus main body unit 5, the joint member 353*b* penetrates the secondary transfer through hole 185 and is attached to a joint member (not illustrated in the drawings) of a secondary transfer drive unit 800 illustrated in FIG. 21. Thereby, the secondary transfer roller 521 is driven and rotated by a drive force of a secondary transfer motor.

As illustrated in FIG. 19, on an inner circumferential surface of the lock through hole 184, lock receiving surfaces 182*a* and 182*b* are formed, which are lock receiving portions which the rotating rollers 162 of the electrical lock mechanism 160 come into contact with and which lock the drawer unit 76 to the apparatus main body unit 5. In FIG. 19, guide surfaces 183*a* and 183*b* for guiding the rotating rollers 162 of the electrical lock mechanism 160 to the lock receiving surfaces 182*a* and 182*b* are connected to the clockwise end portions of the lock receiving surfaces 182*a* and 182*b* respectively.

Figure 22A:
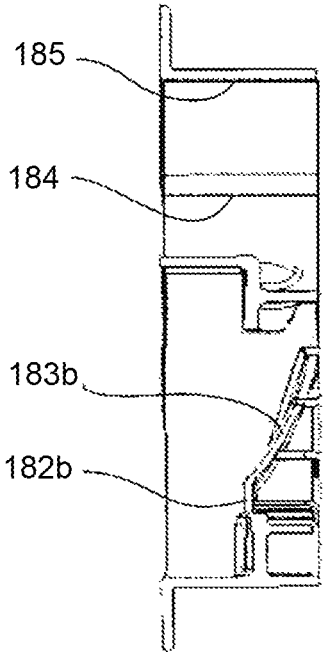
FIG. 22A is a cross-sectional view of the lock receiving member taken along in A-A direction in FIG. 20.
Figure 22B:
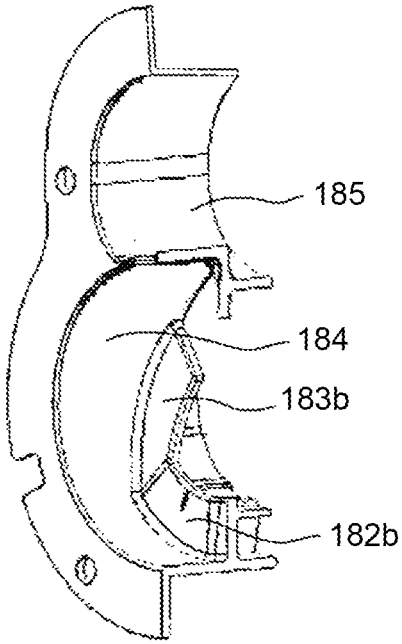
FIG. 22B is a cross-sectional perspective view of the lock receiving member taken along in A-A direction in FIG. 20.

FIGS. 22A and 22B are diagrams of the lock receiving member that is separated in A-A direction in FIG. 20. FIG. 22A is a cross-sectional view of the lock receiving member 180 as seen from the side. FIG. 22B is a cross-sectional perspective view of the lock receiving member.

As illustrated in FIGS. 22A and 22B, the guide surfaces 183*a* and 183*b* are tapered surfaces which incline toward the drawer unit (frontward) as going away from the lock receiving surfaces 182*a* and 182*b*.

As illustrated in FIG. 19 previously, notches 181*a* and 181*b* into which the rotating rollers 162 of the electrical lock mechanism 160 are inserted are formed in the clockwise end portions of the guide surfaces 183*a* and 183*b*.

Also in the counter-clockwise end portions of the lock receiving surfaces 182*a* and 182*b* in FIG. 19, inclined surfaces 186*a* and 186*b* inclined frontward are formed.

Figure 23:
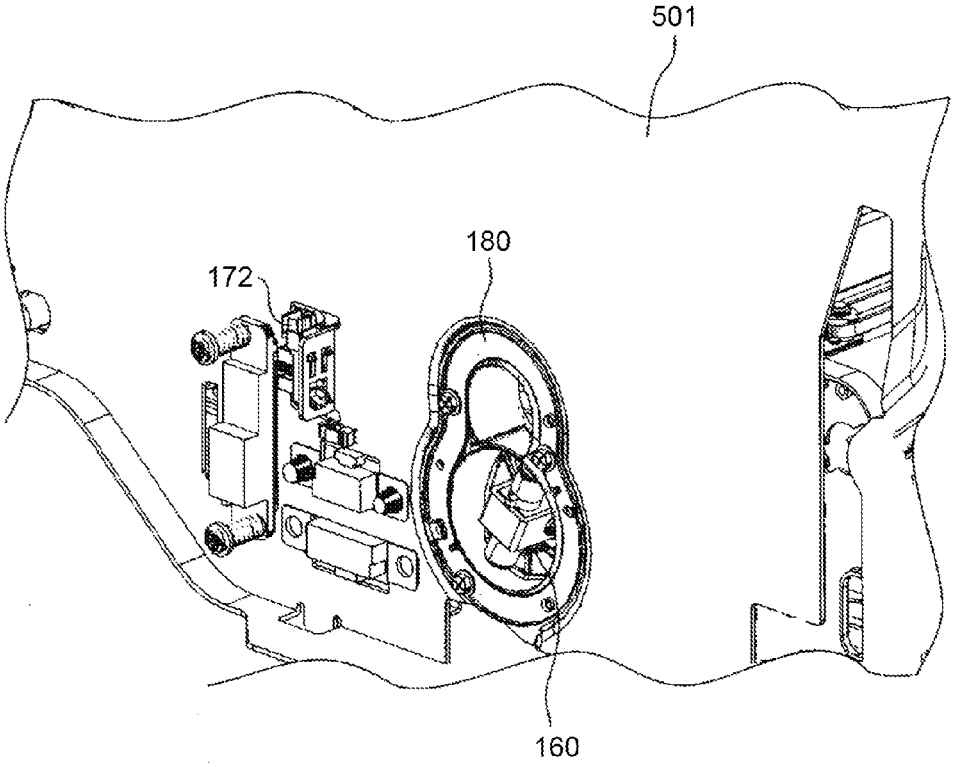
FIG. 23 is a perspective view illustrating a main body rear plate.

As illustrated in FIG. 23, the secondary transfer through hole 185 and the lock through hole 184 of the lock receiving member 180, which have a cylindrical shape, protrude from the main body rear plate 501 toward the side of the drawer unit 76. In this way, the lock receiving member 180 does not protrude from the surface of the main body rear plate 501 on the side opposite to the side of the drawer unit.

As illustrated in FIG. 21, the secondary transfer drive unit 800 is fixed to the rear surface of the main body rear plate 501 with screws 801 so that the secondary transfer drive unit 800 faces the lock receiving member 180. If the lock receiving member 180 protrudes from the surface of the main body rear plate 501 on the side opposite to the side of the drawer unit, the secondary transfer drive unit 800 has to be arranged away from the rear surface of the main body rear plate 501 by a length corresponding to the protrusion of the lock receiving member 180. As a result, there is a risk that the apparatus is enlarged in the drawing direction.

The main body rear plate 501 is a member for positioning a process cartridge including the photoreceptor, a transfer unit including the intermediate transfer belt 54, the drawer unit 76 storing the fixing unit and the secondary transfer apparatus, and the like in the apparatus main body unit 5. Therefore, the main body rear plate 501 is fixed to a rear side surface of the housing 40 (see FIG. 2) of the image reading unit 4. In this way, the main body rear plate 501 is fixed to the rear side surface of the housing 40 (see FIG. 2) of the image reading unit 4, so that it is possible to fix the main body rear plate 501 without tilting in the drawing direction in the apparatus main body unit 5. Thereby, it is possible to accurately position the process cartridge, the transfer unit, the drawer unit 76, and the like in the apparatus main body unit 5.

Generally, the length of the image reading unit 4 in the front-back direction is longer than the length in the width direction of an image that can be formed by the image forming apparatus. On the other hand, the length of the drawer unit 76 and the like in the front-back direction is somewhat longer than the length in the width direction of an image that can be formed by the image forming apparatus. Therefore, when the drawer unit 76 is mounted in the apparatus main body unit 5, there is a certain gap between the drawer unit rear plate 151 and the main body rear plate 501. Therefore, even if the lock receiving member 180 protrudes from the main body rear plate 501 on the side of the drawer unit (on the front side), the drawer unit rear plate 151 does not become an obstacle. Therefore, it is possible to prevent the apparatus from being enlarged in the drawing direction by protruding the lock receiving member 180 from the main body rear plate 501 on the side of the drawer unit.

Next, a lock detection mechanism, which is a lock detection means that detects whether the drawer unit 76 is in the locked state or in the unlocked state, will be described.

Figure 24:
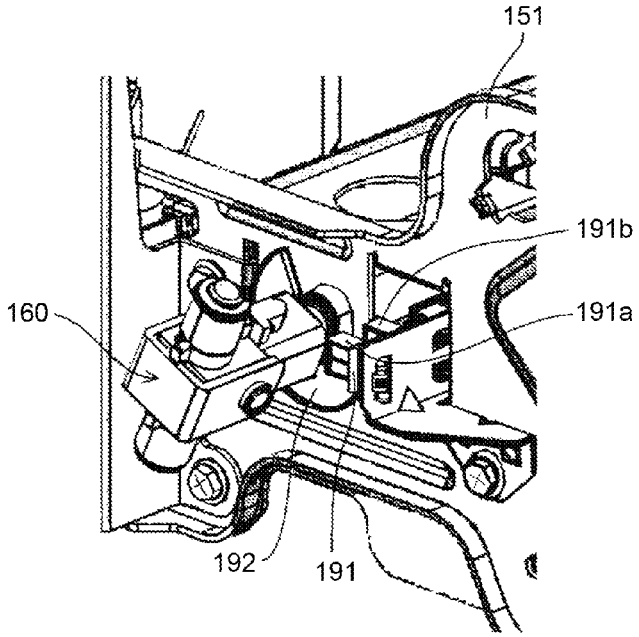
FIG. 24 is a perspective view illustrating a lock detection mechanism.

FIG. 24 is a perspective view illustrating the lock detection mechanism. As illustrated in FIG. 24, the lock detection mechanism includes a lock detection filler 192 which is attached to the lock shaft 703 and has a partially cut-away disk shape and a lock detection sensor 191 which is a photo-interrupter (transmission type optical sensor). The lock detection filler 192 enters between a light receiving unit 191*b* and a light emitting unit 191*a* of the lock detection sensor 191 and blocks light from the light emitting unit 191*a*. Thereby, the light receiving unit 191*b* does not detect the light from the light emitting unit 191*a*, so that a signal from the light emitting unit 191*a* becomes "OFF: blocked state". On the other hand, when there is not the lock detection filler 192 between the light receiving unit 191*b* and the light emitting unit 191*a*, the light receiving unit 191*b* receives the light from the light emitting unit 191*a*. Thereby, the signal from the light receiving unit 191*b* becomes "ON: unblocked state". A control unit 121 (see FIG. 25) recognizes whether the drawer unit 76 is in the locked state or in the unlocked state on the basis of the ON/OFF signal from the light receiving unit 191*b*.

Figure 25:
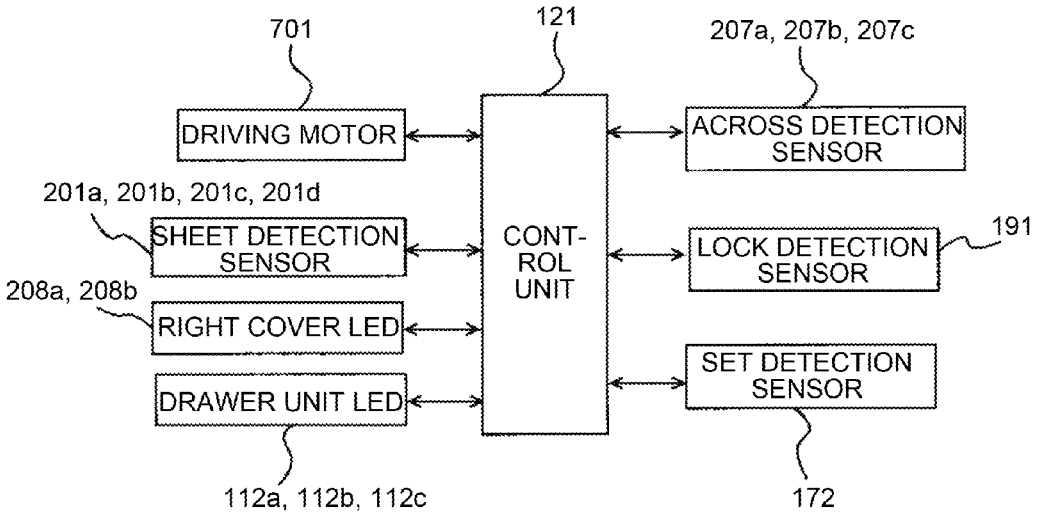
FIG. 25 is a functional block diagram illustrating an example of a main configuration of a control system.

FIG. 25 is a functional block diagram illustrating an example of a main configuration of a control system of the present embodiment.

As illustrated in FIG. 25, the drive motor 701, the paper detection sensors 201*a* to 201*d*, the drawer LEDs 112*a* to 112*c*, and the like are connected to the control unit 121, which is a control means. Further, the straddle sensor 207, the lock detection sensor 191, the set detection sensor 172, the right cover LEDs 208*a* and 208*b*, and the like are connected to the control unit 121. For example, when a control program installed in advance is executed, the control unit 121 controls the lock of the drawer unit 76 by controlling the drive motor 701 and lights the drawer LEDs 112*a* to 112*c* and the right cover LEDs 208*a* and 208*b*.

Next, a lock operation of the drawer unit 76 will be described.

Figure 26:
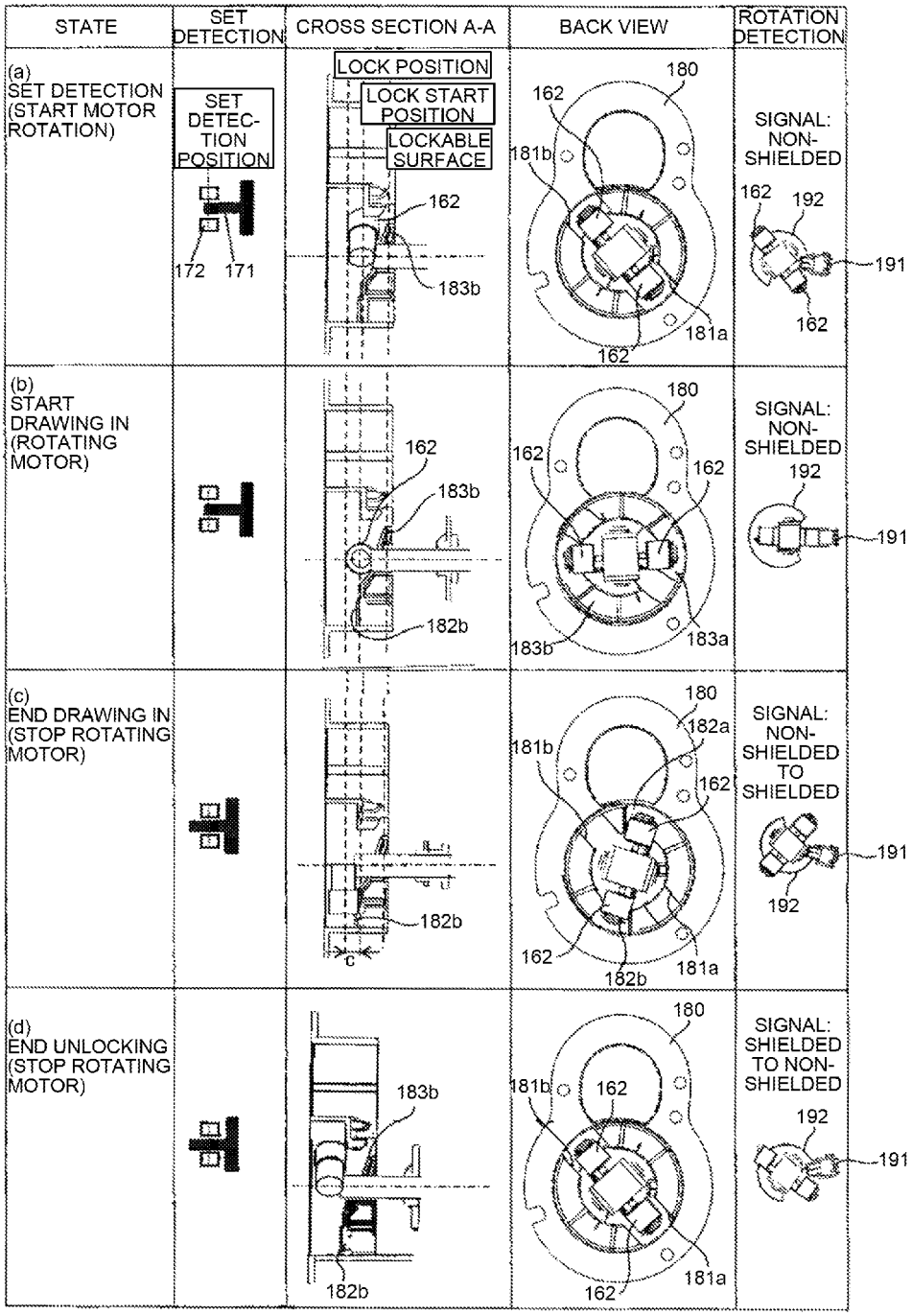
FIG. 26 is a diagram for explaining states of a set detection mechanism, the lock detection mechanism, and the like when an unlocked state changes to a locked state.
Figure 27:
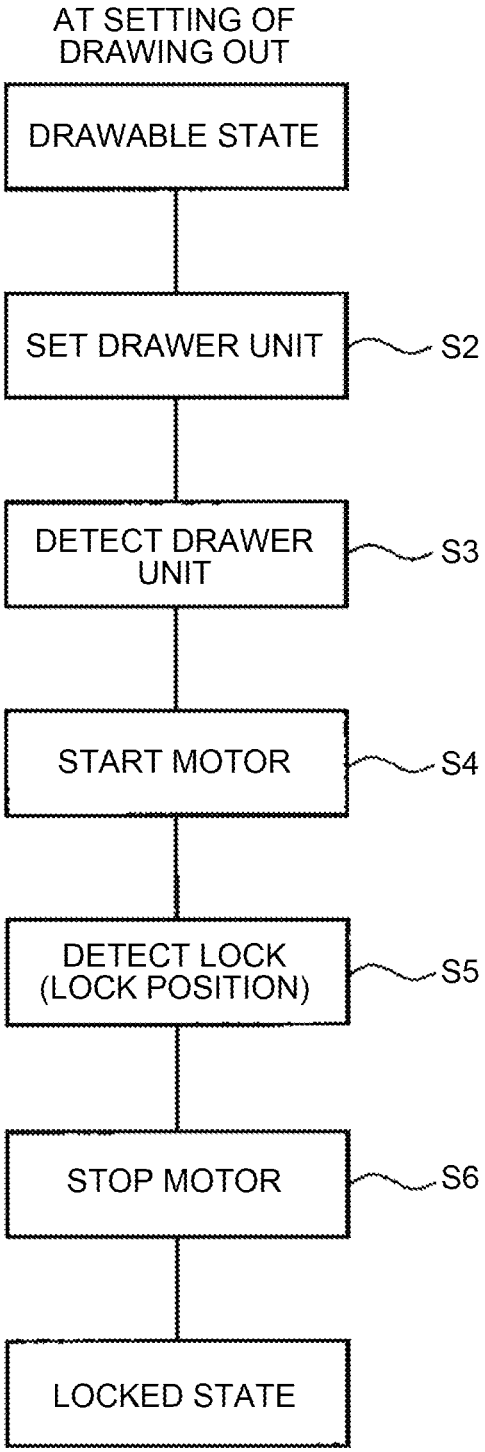
FIG. 27 is an operation flowchart when the unlocked state is changed to the locked state.

FIG. 26 is a diagram for explaining the states of the set detection mechanism, the lock detection mechanism, and the like when the unlocked state changes to the locked state. FIG. 27 is an operation flowchart when the unlocked state is changed to the locked state.

As illustrated in FIG. 26A, when the lock of the drawer unit 76 is released and the drawer unit 76 can be pulled out (S1), the rotating rollers 162 of the electrical lock mechanism 160 are located at positions corresponding to the notches 181*a* and 181*b* of the lock receiving member 180. In the unlocked state, the lock detection filler 192 of the lock detection mechanism is located at a position just away from a position between the light receiving unit 191*b* and the light emitting unit 191*a* of the lock detection sensor 191. Thereby, the light receiving unit 191*b* of the lock detection sensor detects the light from the light emitting unit 191*a* and is "ON: unblocked state". At this time, the secondary transfer roller 521 is located at a separated position separated from the intermediate transfer belt 54 and the link mechanism 710 is in a state as illustrated in FIG. 13.

When the drawer unit 76 is being set in the apparatus main body unit 5 (S2) from this state, the electrical lock mechanism 160 is being inserted into the lock through hole 184 of the lock receiving member 180. When the rotating rollers 162 move beyond the end portions of the guide surfaces 183*a* and 183*b* on the side of the drawer unit, the set detection filler 171 enters between the light receiving unit 172*b* and the light emitting unit 172*a* of the set detection sensor 172 and blocks the light from the light emitting unit 172*a*. Thereby, the set detection unit detects that the drawer unit 76 is set (S3), starts drive of the drive motor 701 illustrated in FIG. 12 (S4), and rotates the lock shaft 703.

When the lock shaft 703 rotates, as illustrated in FIG. 26B, the rotating rollers 162 of the electrical lock mechanism 160 come into contact with the guide surfaces 183*a* and 183*b* and move to the backward lock receiving surfaces 182*a* and 182*b* while being guided by the guide surfaces 183*a* and 183*b*. In this way, the rotating rollers 162 move backward while being guided by the guide surfaces 183*a* and 183*b*, so that the lock shaft 703 is pulled backward. As illustrated in FIG. 11, the E-ring 722 is fixed to the groove of the lock shaft 703 so as to be in contact with the front side surface of the drawer unit rear plate 151. Therefore, when the lock shaft 703 moves backward, the drawer unit rear plate 151 is pushed backward by the E-ring 722, so that the drawer unit 76 is pulled into the apparatus main body unit 5.

Further, the contacting/separating mechanism described above is driven through the lock shaft 703 and the link mechanism 710, so that the secondary transfer roller 521 moves from a separated position to a contact position.

The rotating rollers 162 are rotatably attached to the roller shaft 161, so that the rotating rollers 162 moves on the guide surfaces 183*a* and 183*b* while rotating. Thereby, it is possible to prevent an increase in frictional resistance between the rotating rollers 162 and the guide surfaces 183*a* and 183*b*, so that the drawer unit 76 can be smoothly pulled backward.

In the present embodiment, after the drawing is started by the electrical lock mechanism 160, the positioning pin 152 fits into the positioning hole 502 so that the positioning is performed. If the fitting portion 152*b* of the positioning pin 152 fits into the positioning hole 502 before the drawing is started, the fitting portion 152*b* fits into the positioning hole 502 when the drawer unit 76 is manually pushed in. As a result, the resistance when pushing in the drawer unit 76 increases while manually pushing in the drawer unit 76. As a result, there is a risk that a user misunderstands that the drawer unit 76 is pushed in to the position at which the drawing is started and the user stops pushing the drawer unit 76.

On the other hand, in the present embodiment, after the drawing is started by the electrical lock mechanism 160, the positioning pin 152 fits into the positioning hole 502 so that the positioning is performed. Therefore, it is possible to prevent the resistance against pushing in the drawer unit 76 from abruptly increasing until the drawer unit is pushed in to the position at which the drawing is started by the electrical lock mechanism 160 (the position at which the set detection sensor 172 detects the set detection filler 171). Thereby, it is possible to manually and reliably push in the drawer unit 76 to the position at which the drawing is started by the electrical lock mechanism 160.

It is considered that a configuration in which connectors are provided to the drawer unit 76 and the apparatus main body unit 5 and the connector of the drawer unit 76 is fitted into the connector of the apparatus main body unit to be electrically connected together when the drawer unit 76 is set in the apparatus main body unit is employed. In this case, unless the connectors are fitted to each other, the drive motor 701 cannot be driven. When the connectors are fitted to each other, the resistance of pushing the drawer unit 76 increases. Therefore, there is a risk that a user misunderstands that the drawer unit 76 is pushed in to the position at which the drawing is started and the user stops pushing the drawer unit 76.

However, in the present embodiment, even when the drawer unit 76 is pulled out, power is supplied to the drawer unit 76 through the bundle wire 105, so that the drive motor 701 can be driven. Therefore, it is possible to manually and reliably push in the drawer unit 76 to the position at which the drawing is started as compared with a configuration in which the connector of the drawer unit 76 is fitted into the connector of the apparatus main body to be electrically connected together.

After the positioning pin 152 fits into the positioning hole 502, the drawer unit 76 is still pulled backward by the guide surfaces 183*a* and 183*b* and the seating surface portion 152*c* of the positioning pin 152 provided on the drawer unit rear plate 151 butts against the main body rear plate 501. As illustrated in FIG. 26C, when the rotating rollers 162 of the electrical lock mechanism 160 reaches the lock receiving surfaces 182*a* and 182*b*, the lock detection filler 192 enters between the light receiving unit 191*b* and the light emitting unit 191*a* of the lock detection sensor, so that the lock detection sensor becomes "OFF: blocked state". Thereby, the lock detection mechanism detects that the drawer unit 76 is locked to the apparatus main body unit 5 (S5), and the drive of the drive motor 701 is stopped (S6).

At this time, the secondary transfer roller is in contact with the intermediate transfer belt 54 by a predetermined pressure. At this time, the link mechanism 710 is in a state illustrated in FIG. 28.

In the present embodiment, after the seating surface portion 152*c* of the positioning pin 152 provided on the drawer unit rear plate 151 butts against the main body rear plate 501, the drawer unit 76 is pulled backward by 0 to 1 mm and then the drawer unit 76 is locked to the apparatus main body. Thereby, it is possible to lock the drawer unit 76 to the apparatus main body unit 5 without backlash in the front-back direction. As a result, it is possible to prevent an image from being disturbed by vibration or the like when forming the image.

The drawer unit rear plate 76 and the main body rear plate 501 which are long in the horizontal direction may bend and resin members of the drawer unit 76 that butt against the main body rear plate 501 may be elastically deformed. Thereby, it is possible to pull the drawer unit 76 backward by 0 to 1 mm after the seating surface portion 152*c* of the positioning pin 152 butts against the main body rear plate 501.

When a paper jam or the like occurs and the drawer unit 76 is required to be pulled out, the drive motor 701 is rotated and the electrical lock mechanism 160 is rotated counter-clockwise in the drawings. Then, the rotating rollers 162 move from the lock receiving surfaces 182*a* and 182*b* to the inclined surfaces 186*a* and 186*b*. Then, as illustrated in FIG. 26D, the rotating roller 162 that was in contact with the lock receiving surface 182*a* reaches the position of the notch 181*a* and the rotating roller 162 that was in contact with the lock receiving surface 182*b* reaches the position of the notch 181*b*. Then, the lock detection filler 192 disappears from between the light receiving unit 191*b* and the light emitting unit 191*a* of the lock detection sensor 191. Thereby, the "OFF: blocked state" is changed to the "ON: unblocked state" and the lock detection mechanism can detect that the lock of the drawer unit 76 is released.

Figure 28:
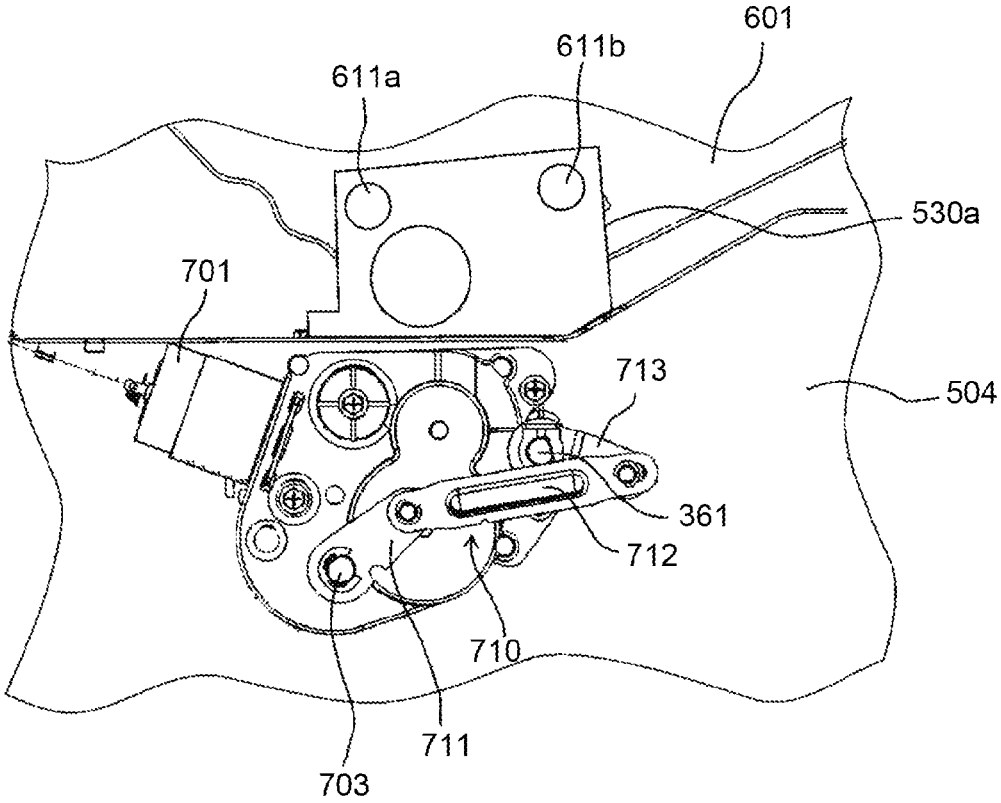
FIG. 28 is a front view of the drive unit when the drawer unit is locked.

When the lock shaft 703 rotates clockwise in FIG. 28 from the state illustrated in FIG. 28, the input shaft 361 rotates counter-clockwise a little in FIG. 28 and thereafter the rotation direction of the input shaft 361 changes to the clockwise direction in FIG. 28. Thereby, the moving direction of the secondary transfer roller 521 is changed from a direction approaching the intermediate transfer belt 54 to a direction moving away from the intermediate transfer belt 54. When the lock is released, the link mechanism 710 becomes the state illustrated in FIG. 13 and the secondary transfer roller 521 reaches a position separated from the intermediate transfer belt 54.

In this way, in the present embodiment, it is possible to automatically lock and unlock the drawer unit 76. Therefore, it is possible to simplify the paper jam processing operation as compared with a case in which the drawer unit 76 is manually locked and unlocked. Thereby, it is possible to improve efficiency of the paper jam processing operation.

The contacting/separating of the secondary transfer roller 521 with respect to the intermediate transfer belt 54 is performed in conjunction with the lock operation of the drawer unit 76. Thereby, whenever the drawer unit 76 can be pulled out, the secondary transfer roller 521 can be separated from the intermediate transfer belt 54. Therefore, when the drawer unit 76 is pulled out from the apparatus main body, it is possible to prevent the secondary transfer roller 521 from rubbing against the intermediate transfer belt 54 and it is possible to inhibit the surface of the secondary transfer roller 521 and the surface of the intermediate transfer belt 54 from being scratched. Further, it is never forgotten to cause the secondary transfer roller 521 to be in contact with the intermediate transfer belt 54.

Further, since the lock of the drawer unit 76 is automatically released by driving the drive motor 701, it is not necessary to perform a lock release operation. Thereby, it is possible to easily perform an operation to pull out the drawer unit 76 as compared with a configuration in which the lock is manually released.

In the configuration of the present embodiment, as illustrated in FIG. 3, the front cover 6 is fixed to the drawer unit 76 and the front cover 6 is pulled out along with the drawer unit 76. In this configuration, if the drawer unit 76 is manually locked and unlocked, it is necessary to provide an operation unit at a position exposed from the apparatus. Therefore, a problem of degrading the appearance of the apparatus occurs. Therefore, for example, it is considered that an operation unit to release the lock of the drawer unit 76 in the handle portion 6*a* is provided. Specifically, it is a configuration in which when a user grips the handle portion 6*a*, the operation unit is pressed and the lock is released.

However, in the present embodiment, as described above, the drawer unit 76 is locked by pulling the drawer unit 76 backward by 0 to 1 mm after the seating surface portion 152*c* of the positioning pin 152 or the like butts against the main body rear plate 501. Therefore, a large force is required when the rotating rollers 162 are moved from the lock receiving surfaces 182*a* and 182*b* to unlock the drawer unit 76 and when the rotating rollers 162 are moved on the guide surfaces 183*a* and 183*b* to lock the drawer unit 76. To easily lock and unlock the drawer unit 76 that is firmly locked to the apparatus main body unit 5 by a user's operation on the operation unit, it is necessary to increase the amount of operation on the operation unit.

Therefore, if the drawer unit 76 that is firmly locked to the apparatus main body unit 5 is locked and unlocked by the amount of operation of gripping the handle portion 6*a*, a very large force is required for the operation and it is not easy to move the operation unit.

On the other hand, in the present embodiment, it is possible to prevent the appearance of the apparatus from being degraded by automatically performing the lock and unlock of the drawer unit 76.

When the lock shaft 703 is easily rotated, there is a risk that the lock shaft 703 is rotated when the drawer unit 76 is mounted. If the lock shaft 703 is rotated when the drawer unit 76 is mounted, the rotating rollers 162 of the electrical lock mechanism 160 may not be inserted into the notches 181*a* and 181*b* but may butt against the guide surfaces 183*a* and 183*b* or the like, so that there is a risk that the drawer unit 76 cannot be mounted. Further, there is a risk that the lock shaft 703 is rotated by vibration or the like when the drawer unit 76 is mounted in the apparatus main body unit 5 and the lock of the drawer unit 76 is released.

Therefore, in the present embodiment, the worm gear 704 having a large reduction ratio and a high torque is used to transmit a drive force from the drive motor 701 to the lock shaft 703. It is possible to make the lock shaft 703 difficult to rotate by using the worm gear 704. Thereby, it is possible to prevent a problem that the drawer unit 76 cannot be mounted in the apparatus main body and a problem that the lock is unlocked by vibration or the like from occurring.

In the present embodiment, as illustrated in FIG. 18, the set detection sensor 172 is arranged near the lock receiving member 180. If the set detection sensor 172 is arranged at a position away from the lock receiving member 180, the problem described below occurs. Specifically, there is a risk that the set detection sensor 172 detects the set detection filler 171 before the rotating rollers 162 are located behind the guide surfaces 183*a* and 183*b* by being largely affected by deformation of the drawer unit rear plate 151 and deformation of the main body rear plate 501.

On the other hand, in the present embodiment, the set detection sensor 172 is arranged near the lock receiving member 180, so that it is possible to suppress the effects of the deformation of the drawer unit rear plate 151 and the deformation of the main body rear plate 501. Thereby, it is possible to prevent the problem that the set detection sensor 172 detects the set detection filler 171 before the rotating rollers 162 are located behind the guide surfaces 183*a* and 183*b*.

In the present embodiment, when the lock is released, the rotating rollers 162 are guided from the lock receiving surfaces 182*a* and 182*b* to the inclined surfaces 186*a* and 186*b* and move to the notches 181*a* and 181*b*. The inclined surfaces 186*a* and 186*b* are provided in this way, so that it is possible to prevent a torque from changing suddenly and the load applied to the drive motor 701 and the like can be reduced.

Figure 29:
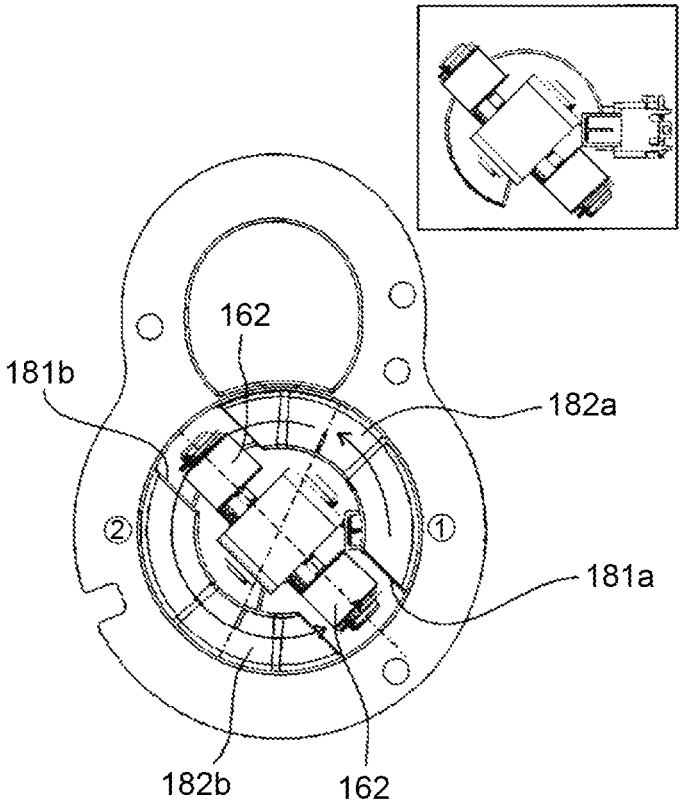
FIG. 29 is a diagram for explaining movement of a rotating roller when the locked state changes to the unlocked state.

In the present embodiment, as illustrated in FIG. 29, unlock->lock->unlock is performed by one rotation operation of the lock shaft 703. This is because, as described by using FIGS. 13 and 28, the secondary transfer roller 521 is caused to be in contact with or separated from the intermediate transfer belt 54 by changing the rotation direction of the input shaft 361 in the one rotation operation of the lock shaft 703 by using the link mechanism 710. Therefore, when the lock of the drawer unit 76 and the contacting/separating of the secondary transfer roller 521 are performed separately, a configuration illustrated in FIG. 30 may be employed.

Figure 30:
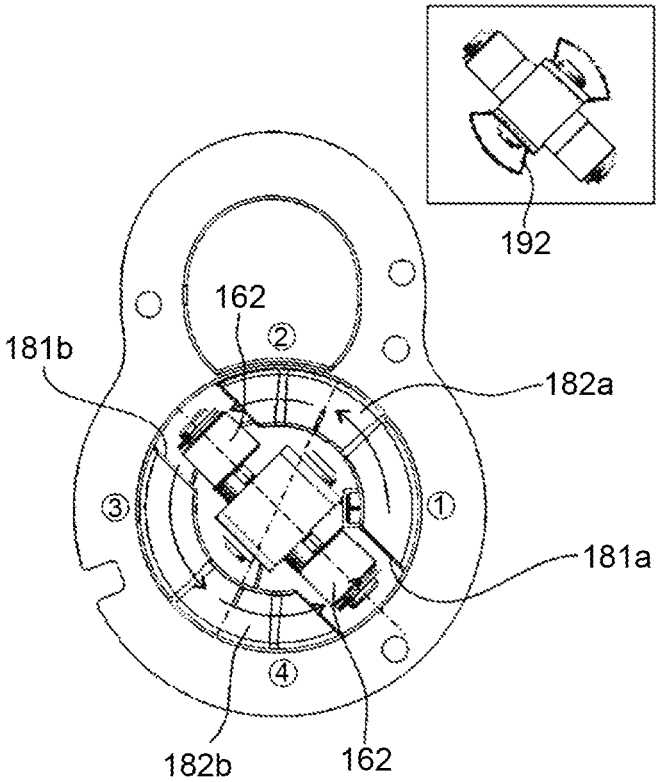
FIG. 30 is a diagram illustrating a form in which an operation of unlock->lock->unlock is performed by (½) rotation operation of a lock shaft.

In the configuration illustrated in FIG. 30, as illustrated, unlock->lock->unlock is performed by (½) rotation operation of the lock shaft 703. Therefore, the lock detection filler 192 of the lock detection mechanism is formed into a fan shape and two lock detection fillers 192 are provided along the circumferential direction of the lock shaft 703 at intervals of 180°.

By employing this configuration, when the rotating roller 162 that was in contact with the lock receiving surface 182*a* reaches the notch 181*b*, the lock detection sensor 191 is switched from the "OFF: blocked state" to the "ON: unblocked state" and it is detected that the lock is released. By employing this configuration, it is possible to reduce the time required for the locked state to change to the unlocked state.

Figure 31:
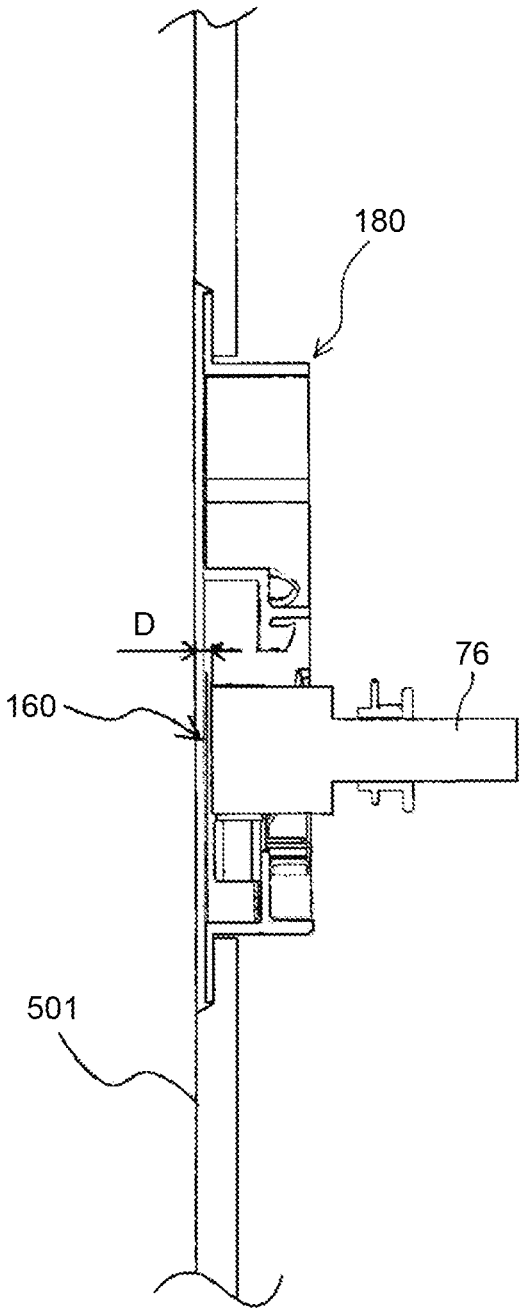
FIG. 31 is a diagram for explaining a positional relationship between the lock receiving member and the lock mechanism in a drawing direction when the drawer unit is locked.

In the present embodiment, as illustrated in FIG. 31, when the drawer unit 76 is locked, the rear end portion of the electrical lock mechanism 160 is located a distance D in front of the rear surface of the main body rear plate 501. In this way, when the drawer unit 76 is locked to the apparatus main body, the electrical lock mechanism 160 does not protrude from the rear surface of the main body rear plate 501. Therefore, the secondary transfer drive unit 800 provided to face the lock receiving member 180 illustrated in FIG. 21 can be provided to be in contact with the rear surface of the main body rear plate 501. Thereby, it is possible to reduce the size of the image forming apparatus in the front-back direction.

Figure 32:
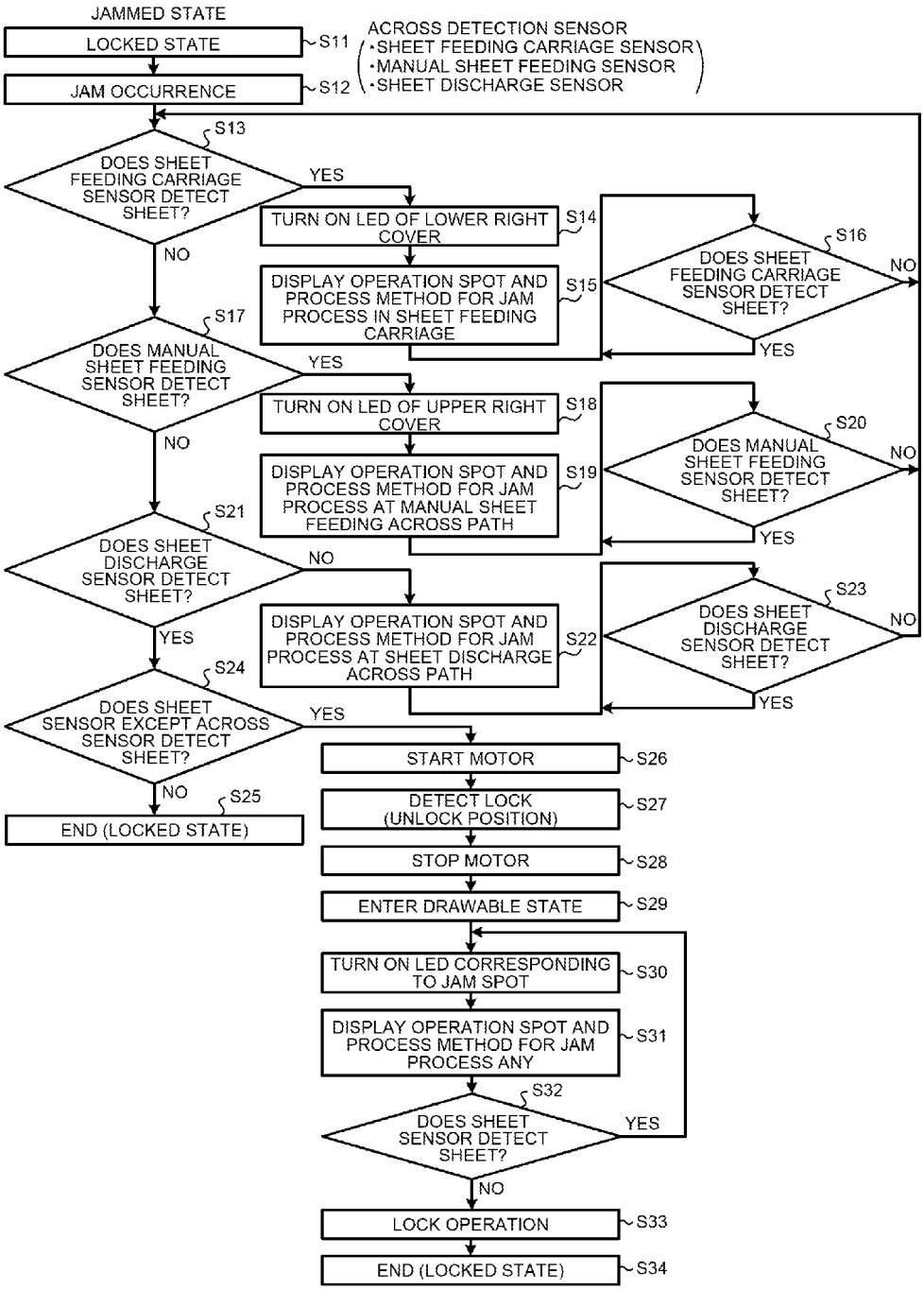
FIG. 32 is an operation flowchart when a paper jam occurs.

FIG. 32 is an operation flowchart when a paper jam occurs.

When an image forming operation is performed, the drawer unit 76 is locked to the apparatus main body unit 5 (S11). If a plurality of paper detection sensors arranged along the conveyance paths such as the main conveyance path 70 and the reverse conveyance path 73 detect that a paper jam occurs (S12), the drive of the conveying rollers is stopped. Next, the control unit 121 checks whether or not the paper feed conveyance sensor 207*a*, which is a straddle detection sensor, detects paper (S13).

When the paper feed conveyance sensor 207*a* detects paper (Yes in S13), there is paper in the paper feed path straddling portion A illustrated in FIG. 6. Therefore, at this time, the lower right cover LED 208*a* provided on the right cover member of the paper feed unit 3 is lit and a message indicating that there is paper in the paper feed path straddling portion A, a paper jam processing operation position, a paper jam processing method, and the like are displayed on an operation display unit not illustrated in the drawings and a user is notified of the above (S15).

The user visually checks the operation display unit not illustrated in the drawings and the lit lower right cover LED 208*a*, opens the right cover member of the paper feed unit 3, and removes the paper at the paper feed path straddling portion A. When the paper jam processing of the user is completed and the paper feed conveyance sensor 207*a* does not detect paper (No in S16), the lower right cover LED 208*a* is turned off and the display of the operation display unit is turned off.

When the paper feed conveyance sensor 207*a* does not detect paper (No in S13), the control unit 121 checks whether or not the manual paper feed sensor 207*b* detects paper (S17). When the manual paper feed sensor 207*b* detects paper (Yes in S17), there is paper in the manual feed path straddling portion B illustrated in FIG. 6. Therefore, at this time, the upper right cover LED 208*b* provided on the right cover member of the apparatus main body unit 5 is lit. Further, a message indicating that there is paper in the manual feed path straddling portion B, a paper jam processing operation position, a paper jam processing method, and the like are displayed on the operation display unit not illustrated in the drawings (S19).

The user follows content displayed on the operation display unit not illustrated in the drawings, visually checks lighting of the lower right cover LED 208*a*, and removes paper straddling over the manual feed path straddling portion B. When paper straddles over the manual feed path straddling portion B, the rear edge of the paper is located on the manual feed tray 32*a*. Therefore, the user can perform the paper jam processing by holding the rear edge of the paper located on the manual feed tray and pulling out the paper.

When the paper at the manual feed path straddling portion B is removed and the manual paper feed sensor 207*b* does not detect paper (No in S20), the upper right cover LED 208*b* is turned off and the display of the operation display unit is turned off.

When the paper feed conveyance sensor 207*a* and the manual paper feed sensor 207*b* do not detect paper (No in S13 and No in S17), the control unit 121 checks whether or not the paper discharge sensor 207*c* detects paper (S21). When the paper discharge sensor 207*c* detects paper (Yes in S21), there is paper in the paper discharge path straddling portion C illustrated in FIG. 6. Therefore, at this time, a message indicating that there is paper in the paper discharge path straddling portion C, a paper jam processing operation position, a paper jam processing method, and the like are displayed on the operation display unit not illustrated in the drawings and a user is notified of the above (S22).

The user removes the paper located at the paper discharge path straddling portion C by following the instruction on the operation display unit not illustrated in the drawings. When paper straddles over the paper discharge path straddling portion C, the edge of the paper is located on the paper discharge tray 61. Therefore, the user can perform the paper jam processing by holding the edge of the paper located on the paper discharge tray and pulling out the paper.

When the paper at the paper discharge path straddling portion C is removed and the paper discharge sensor 207*c* does not detect paper (No in S23), the display of the operation display unit is turned off. An LED may be provided on the left cover member of the apparatus main body unit 5 and an operation position for removing the paper at the paper discharge path straddling portion C may be displayed by lighting the LED when the paper discharge sensor 207*c* detects paper.

When none of the paper feed conveyance sensor 207*a*, the manual paper feed sensor 207*b*, and the paper discharge sensor 207*c* does not detect paper (No in S13, No in S17, and No in S21), the control unit 121 checks whether or not any one of a plurality of paper detection sensors in the drawer unit detects paper (S24). When the paper detection sensors in the drawer unit 76 do not detect paper (No in S24), the paper jam processing is completed (S25).

On the other hand, when the paper detection sensors in the drawer unit 76 detect paper (Yes in S24), an unlock operation of the drawer unit 76 is performed. Specifically, as described above, the rotating rollers 162 that are in contact with the lock receiving surfaces 182*a* and 182*b* are moved to the notches 181*a* and 181*b* by driving the drive motor 701. The rotating rollers 162 reach the positions of the notches 181*a* and 181*b* and the lock detection sensor 191 is switched from the "OFF: blocked state" to the "ON: unblocked state". When it is detected that the lock is released (S27), the drive motor 701 is stopped (S28) and the drawer unit 76 is made to be able to be pulled out (S29).

Next, the drawer unit LEDs 112*a* to 112*c* illustrated in FIG. 5 are lit on the basis of detection results of the paper detection sensors arranged in the conveyance paths in the drawer unit 76 (S30). Further, a paper jam processing operation position, a paper jam processing method, and the like are displayed on the operation display unit not illustrated in the drawings and the user is notified of the above (S31).

For example, when the set detection sensor 172 detects that the drawer unit 76 is set, a message that the drawer unit 76 should be pulled out is displayed on the operation display unit. An LED may be provided on an upper portion of the handle portion 6*a* of the front cover 6 and an operation position may be displayed for the user by lighting the LED. When the user pulls out the drawer unit 76 and the set detection sensor 172 does not detect that the drawer unit 76 is set, a procedure to remove the paper in the drawer unit 76 is displayed on the operation display unit.

The user removes the paper in a conveyance path in the drawer unit 76 on the basis of the instruction on the operation display unit and the lighting display of the drawer unit LEDs 112*a* to 112*c*. When none of the plurality of paper detection sensors arranged at the conveyance paths in the drawer unit 76 detects paper (No in S32), a message that the drawer unit 76 should be closed is displayed on the operation display unit. Then, the lock operation flow illustrated in FIG. 27 is performed (S33), the drawer unit 76 is locked, and the paper jam processing is completed (S34).

In this way, in the present embodiment, when any one of the paper feed conveyance sensor 207*a*, the manual paper feed sensor 207*b*, and the paper discharge sensor 207*c* detects paper, the drawer unit 76 is in the locked state. Therefore, when there is paper at any one of the paper feed path straddling portion A, the manual feed path straddling portion B, and the paper discharge path straddling portion C, the drawer unit 76 is not pulled out. Thereby, it is possible to prevent the forced paper tearing from occurring.

Further, in the present embodiment, when paper is jammed in a conveyance path in the drawer unit 76, the lock of the drawer unit 76 is released and the drawer unit 76 can be pulled out. Thereby, it is possible to prevent the drawer unit 76 from recklessly pulled out and components in the drawer unit 76 from being damaged.

Further, in the present embodiment, it is possible to cause the paper jam processing to be appropriately performed by displaying the operation position of the paper jam processing by the operation display unit and the LEDs. Thereby, it is possible to prevent the user from pulling out the drawer unit 76 in the locked state.

Figure 9:
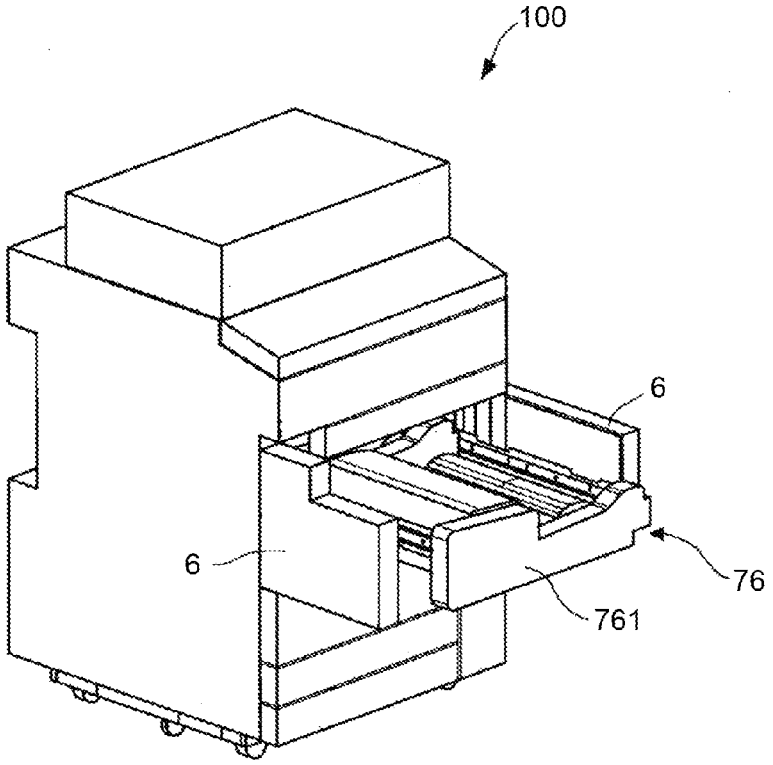
FIG. 9 is a perspective view of the image forming apparatus in which the front cover is separated from the drawer unit.

In the above description, the embodiment is described in which the present invention is applied to an image forming apparatus having a configuration where the front cover 6 is attached to the drawer unit 76 and the front cover 6 and the drawer unit 76 are pulled out together. However, the present invention can be applied to an image forming apparatus having a configuration illustrated in FIG. 9 in which the front cover 6 and the drawer unit 76 are separated from each other and the drawer unit 76 is pulled out after opening the front cover 6. Also in the configuration illustrated in FIG. 9, when there is paper at any one of the paper feed path straddling portion A, the manual feed path straddling portion B, and the paper discharge path straddling portion C, the drawer unit 76 is automatically locked so the unit is not to be pulled out. Thereby, it is possible to prevent the forced paper tearing from occurring.

In the image forming apparatus of the present embodiment, in addition to the electrical lock mechanism 160, a mechanical lock mechanism 260 is provided where the drawer unit 76 is locked and unlocked to and from the apparatus main body unit 5 by a mechanical operation performed by a user.

Figure 1:
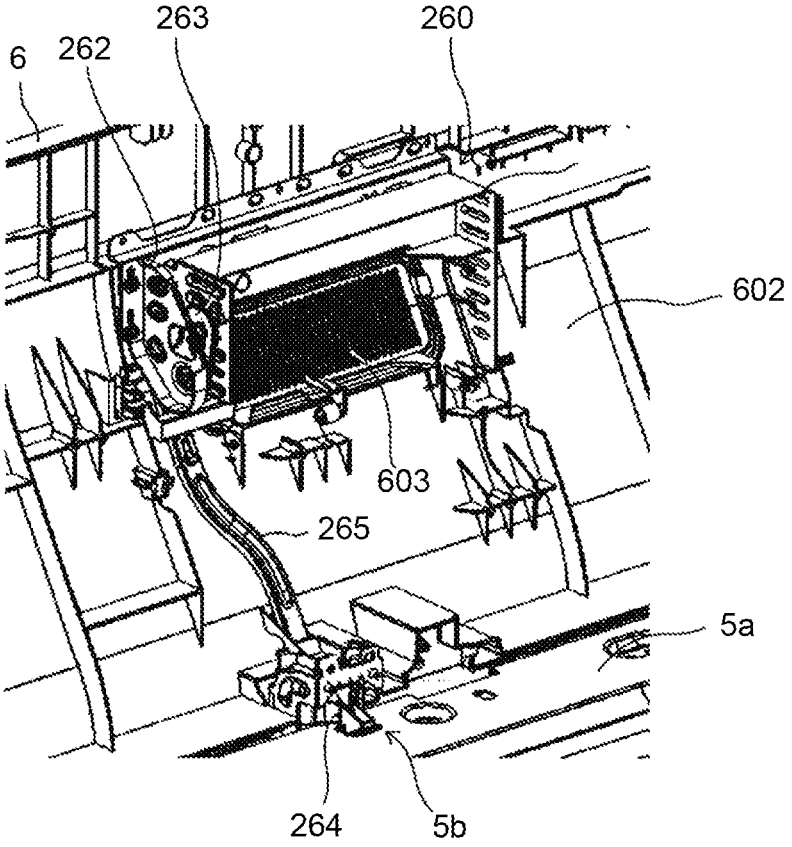
FIG. 1 is a schematic diagram of a mechanical lock mechanism attached to a front cover as seen from the inside of the front cover.
Figure 33:
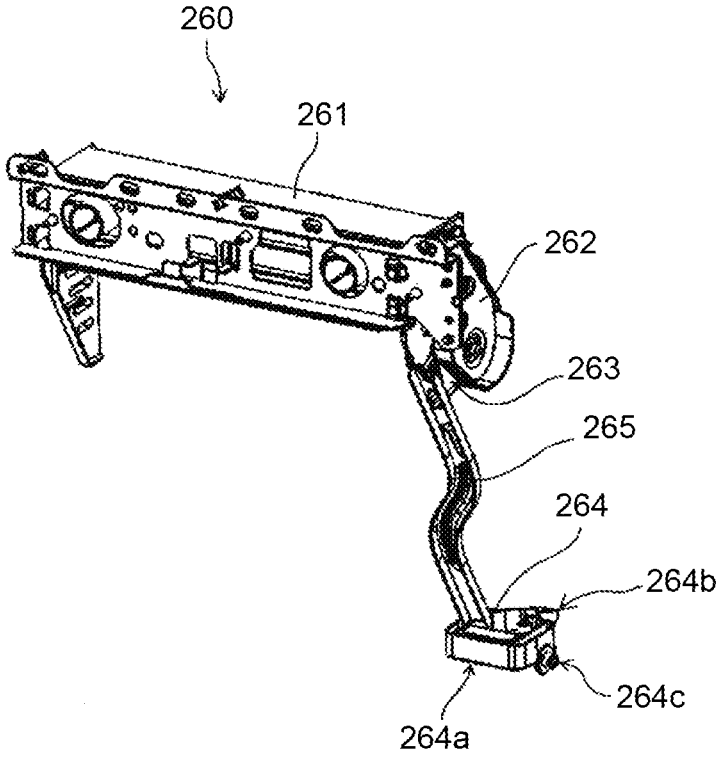
FIG. 33 is a schematic diagram of the mechanical lock mechanism as seen from the front of the apparatus.
Figure 34:
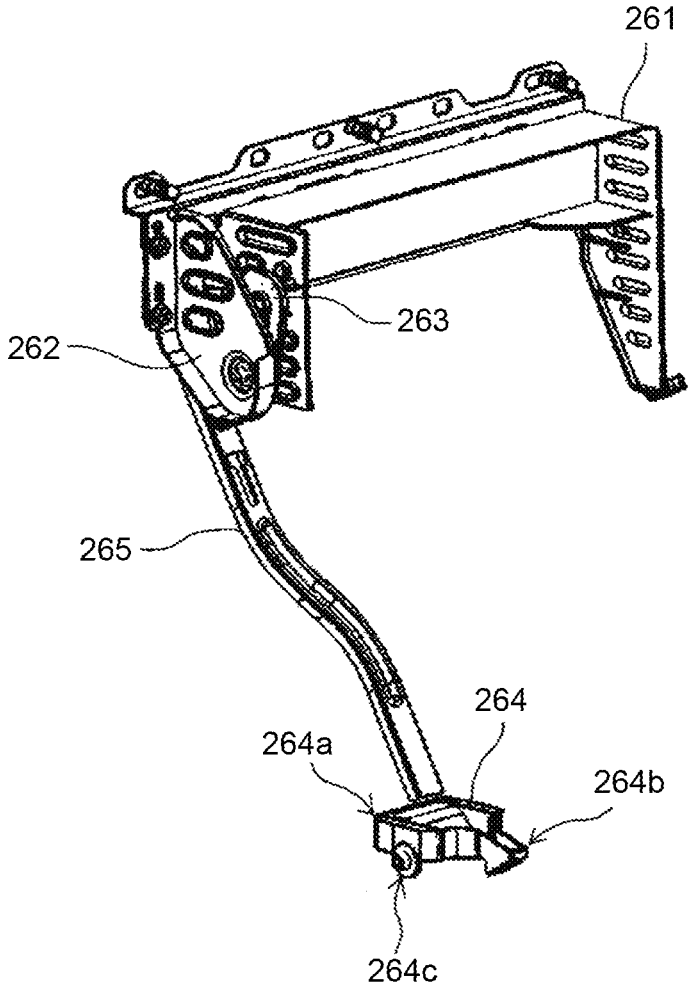
FIG. 34 is a schematic diagram of the mechanical lock mechanism as seen from the back of the apparatus.
Figure 35:
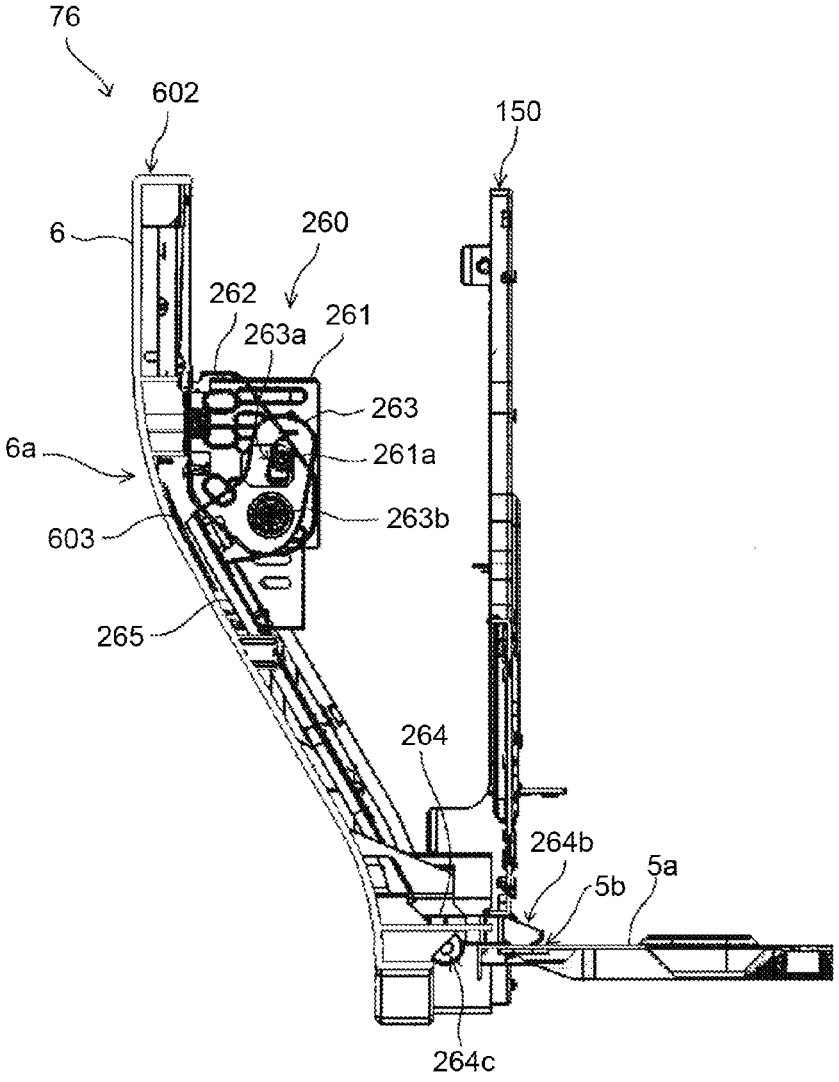
FIG. 35 is a diagram illustrating a locked state by the mechanical lock mechanism.
Figure 36:
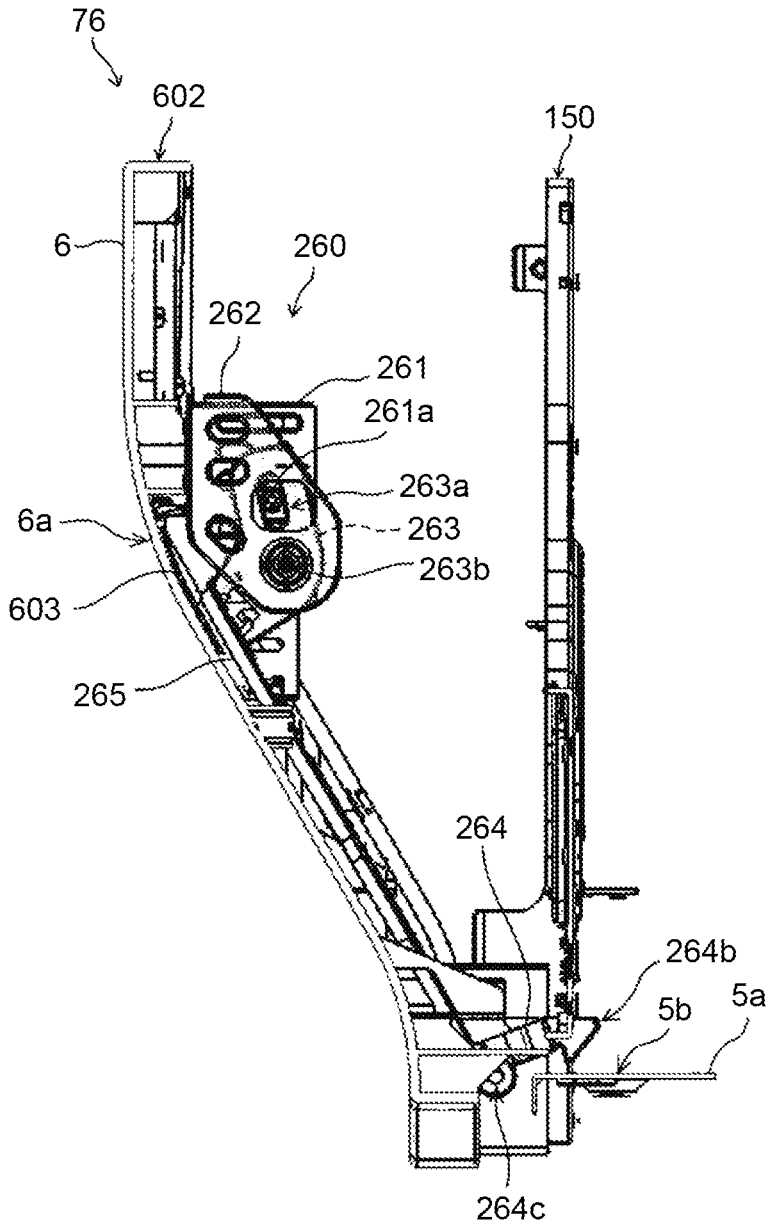
FIG. 36 is a diagram illustrating an unlocked state by the mechanical lock mechanism.

FIG. 1 is a schematic diagram of the mechanical lock mechanism 260 attached to the front cover 6 as seen from the inside of the front cover. FIG. 33 is a schematic diagram of the mechanical lock mechanism 260 as seen from the front of the apparatus. FIG. 34 is a schematic diagram of the mechanical lock mechanism 260 as seen from the back of the apparatus. FIG. 35 is a diagram illustrating a locked state by the mechanical lock mechanism 260. FIG. 36 is a diagram illustrating an unlocked state by the mechanical lock mechanism.

Figure 37:
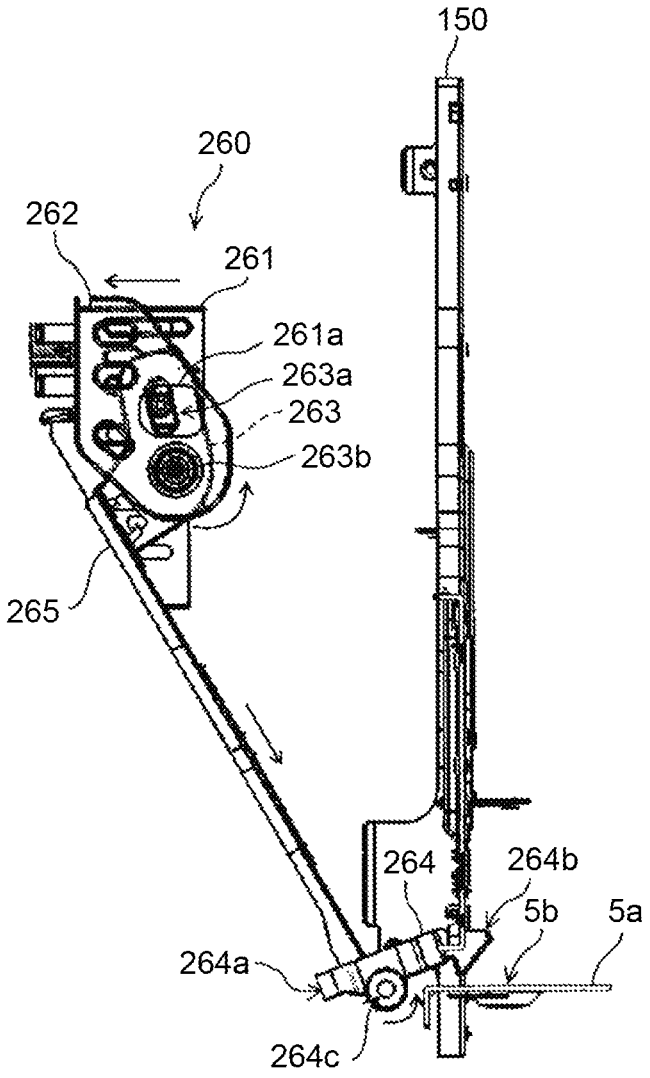
FIG. 37 is an illustration of an unlock operation by the mechanical lock mechanism.
Figure 38:
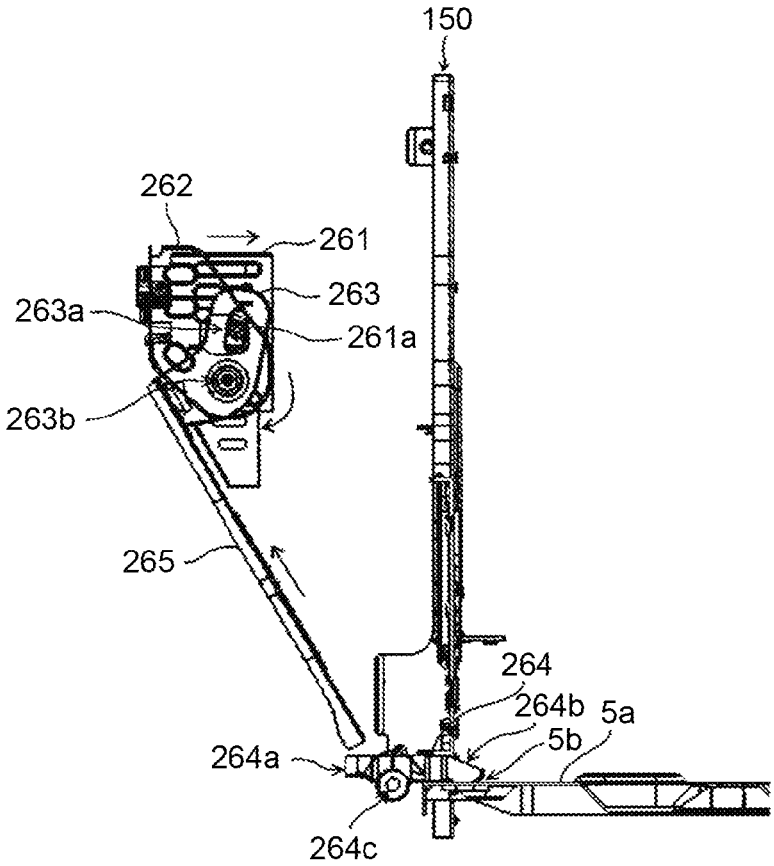
FIG. 38 is an illustration of a lock operation by the mechanical lock mechanism.

FIG. 37 is an illustration of an unlock operation by the mechanical lock mechanism 260. FIG. 38 is an illustration of a lock operation by the mechanical lock mechanism 260.

Figure 39:
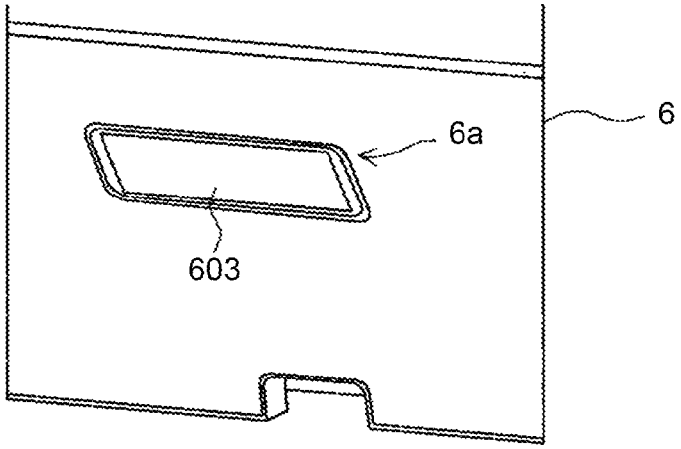
FIG. 39 is a schematic diagram of a handle portion of the front cover as seen from the outside of the front cover.

In the mechanical lock mechanism 260, the user puts his or her hand into the handle portion 6*a* provided in the front cover 6 illustrated in FIG. 39, pushes and opens a flapper 603, and grips a lever 261 illustrated in FIG. 37 and the like to pull the lever 261 toward the front cover 6. Then, the lever 261 is displaced toward the front cover 6 side from a predetermined initial position.

Figure 40:
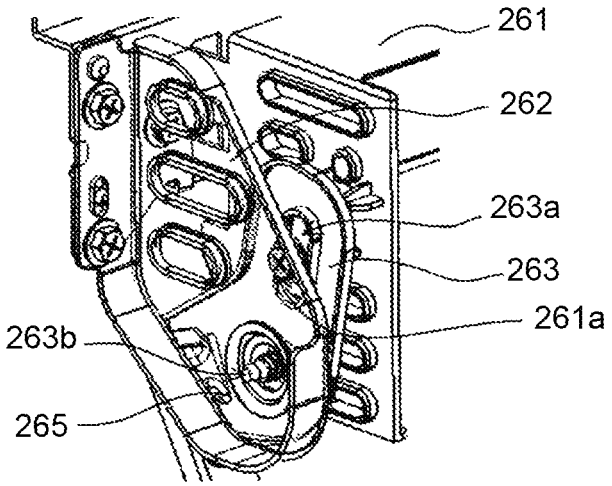
FIG. 40 is an enlarged view of a portion around a side surface of a lever.

FIG. 40 is an enlarged view of a portion around a side surface of the lever 261. On the side surface of the lever 261, a guide pin 261*a* that fits into a long hole 263*a* of an input link 263 rotatably held by a link holding member 262 through a rotating shaft 263*b* is provided. The guide pin 261*a* moves in the long hole 263*a* in conjunction with the displacement of the lever 261 and thereby the input link 263 rotates around the rotating shaft 263*b*.

The guide pin 261*a* moves toward the front cover 6 side in conjunction with the displacement of the lever 261 toward the front cover 6 side, so that the input link 263 rotates counter-clockwise in FIG. 37 around the rotating shaft 263*b*. The input link 263 rotates in this way, so that a rod-shaped output link 265 engaged with the lower end of the input link 263 is pushed by the input link 263 and moves downward. Then, a front end portion 264*a* of a lock claw 264 over the lock hole portion 5*b* provided in a main body frame 5*a* of the apparatus main body unit 5 is pushed by the lower end of the output link 265.

Figure 41:
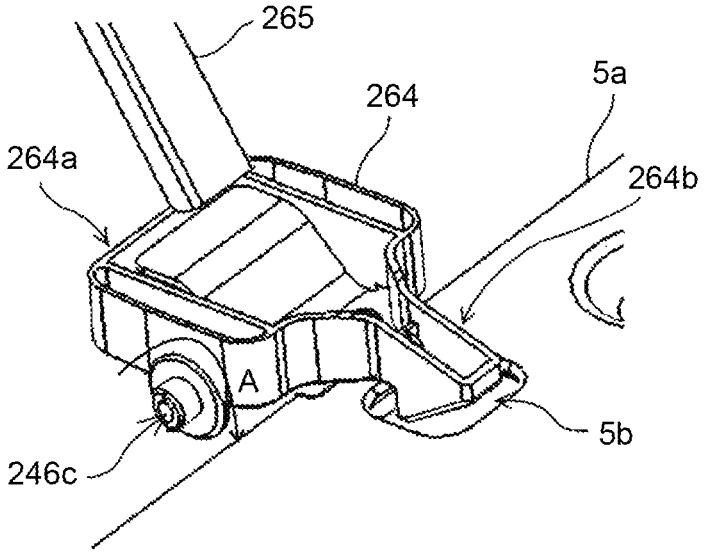
FIG. 41 is an enlarged view of a lock claw and a portion around the lock claw.

As illustrated in FIG. 41, in the lock claw 264, a rotating shaft 264*c* pivotally supported by a bearing (not illustrated in FIG. 41) of the drawer unit 76 is provided. When a deep end portion 264*b* of the lock claw 264 is not pushed by the output link 265, the front end portion 264*a* of the lock claw 264 is urged downward by a spring not illustrated in the drawings so that a force in an arrow A direction illustrated in the drawings is applied around the rotating shaft 264*c*.

Figure 42:
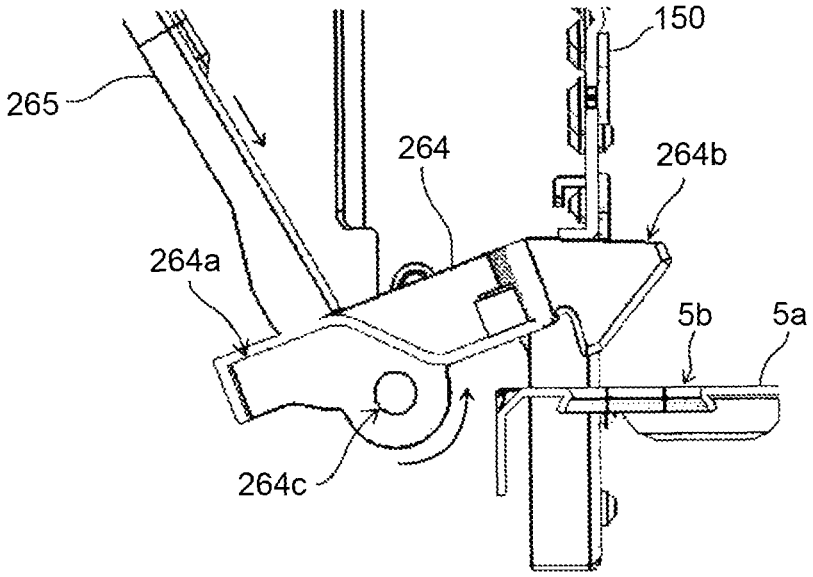
FIG. 42 is a diagram illustrating an operation when a deep end portion of the lock claw is disengaged from a lock hole portion.

When the front end portion 264*a* of the lock claw 264 is pushed down by the output link 265, as illustrated in FIG. 42, the lock claw 264 rotates counter-clockwise in FIG. 42 around the rotating shaft 264*c* against the urging force from the spring not illustrated in the drawings. Thereby, the deep end portion 264*b* of the lock claw 264 that fits into the lock hole portion 5*b* of the main body frame 5*a* is removed from the lock hole portion 5*b*. Therefore, the lock of the drawer unit 76 to the apparatus main body unit 5 by the mechanical lock mechanism 260 is released and the drawer unit 76 can be pulled out from the apparatus main body unit 5.

Figure 43:
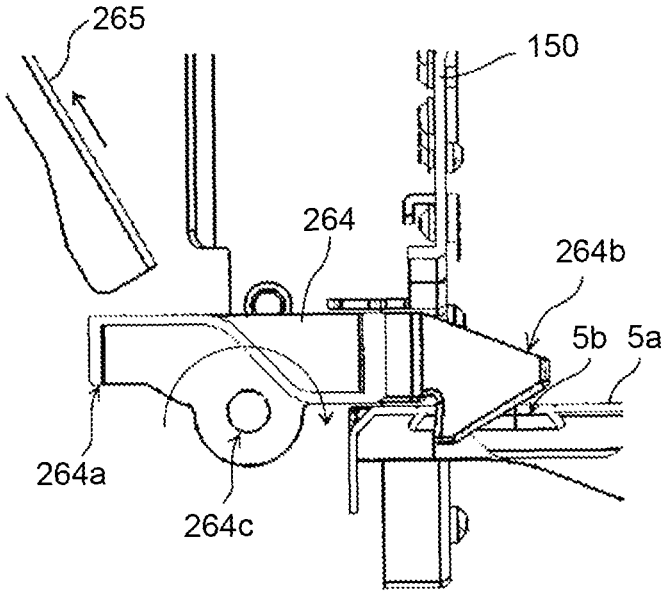
FIG. 43 is a diagram illustrating an operation when the deep end portion of the lock claw fits into the lock hole portion.

On the other hand, when the user stops gripping the lever 261, the lever 261 is urged in a direction moving away from the front cover 6 by the spring not illustrated in the drawings and the lever 261 returns to the initial position (position illustrated in FIG. 35). Thereby, the input link 263 and the output link 265 of a link mechanism 230 return to the initial positions (positions illustrated in FIG. 35) and the front end portion 264*a* of the lock claw 264 is not pushed down by the output link 265. Then, the lock claw 264 is urged by the spring not illustrated in the drawings, rotates clockwise in FIG. 38, and returns to initial posture (posture illustrated in FIG. 35). In this state, if the drawer unit 76 pulled out from the apparatus main body unit 5 is set in a predetermined setting position in the apparatus main body unit 5, as illustrated in FIG. 43, the deep end portion 264*b* of the lock claw 264 fits into the lock hole portion 5*b* of the main body frame 5*a*. Thereby, the lock by the mechanical lock mechanism 260 is performed.

There is a case in which the user sets the drawer unit 76 in a predetermined setting position in the apparatus main body unit 5 while gripping the lever 261. Also in this case, when the user stops gripping the lever 261 after setting the drawer unit 76, the deep end portion 264*b* of the lock claw 264 fits into the lock hole portion 5*b* and the lock by the mechanical lock mechanism 260 is performed.

In the mechanical lock mechanism 260, unless the user puts his or her hand into the handle portion 6*a*, pushes and opens the flapper 603, and grips the lever 261, the lock of the drawer unit 76 to the apparatus main body unit 5 will not be released. Further, the lever 261 is arranged behind the flapper 603 in the drawer unit, so that even when receiving vibration or shock, a force that displaces the lever 261 toward the front cover 6 is not applied. Therefore, the lock of the drawer unit 76 to the apparatus main body unit 5 will not be released. In other words, the drawer unit 76 is locked to the apparatus main body unit 5 by the mechanical lock mechanism 260, so that it is possible to prevent the drawer unit 76 from abruptly protruding from the apparatus main body unit 5 by vibration or the like.

Figure 44:
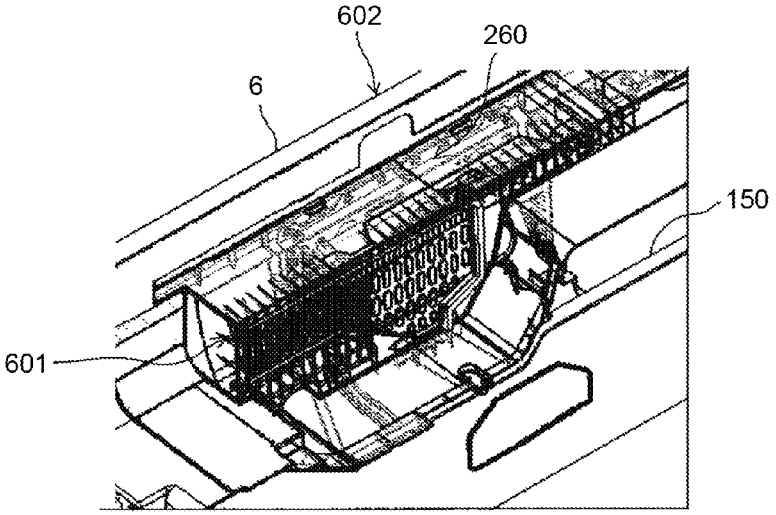
FIG. 44 is an illustration of an arrangement position of the mechanical lock mechanism.

As illustrated in FIG. 44, the mechanical lock mechanism 260 is arranged between the outer cover unit 602 and the inner cover unit 601 of the front cover 6 and attached to the front cover 6. However, the mechanical lock mechanism 260 may be attached to the drawer unit front plate 150 or may be attached to another member. On the other hand, if the front cover 6 and the mechanical lock mechanism 260 can be integrally removed from the drawer unit 76, it is possible to prevent the removal operation of the front cover 6 from being troublesome during maintenance.

Here, when the lock by the electrical lock mechanism 160 is still performed, even if the lock by the mechanical lock mechanism 260 is released, the drawer unit 76 cannot be pulled out. Therefore, the timing at which the electrical lock mechanism 160 performs the lock and unlock is important.

For example, during an image output operation and during an adjustment operation of image forming conditions such as process control, the lock is performed by the electrical lock mechanism 160 and the drawer unit 76 cannot be pulled out. For example, during periods of time when the main power supply is ON and an image forming operation is on standby, when a paper jam occurs, when a serviceman is called due to waste toner full or the like, and when the main power supply is OFF, the lock by the electrical lock mechanism 160 is released and the drawer unit 76 can be pulled out.

Figure 45:
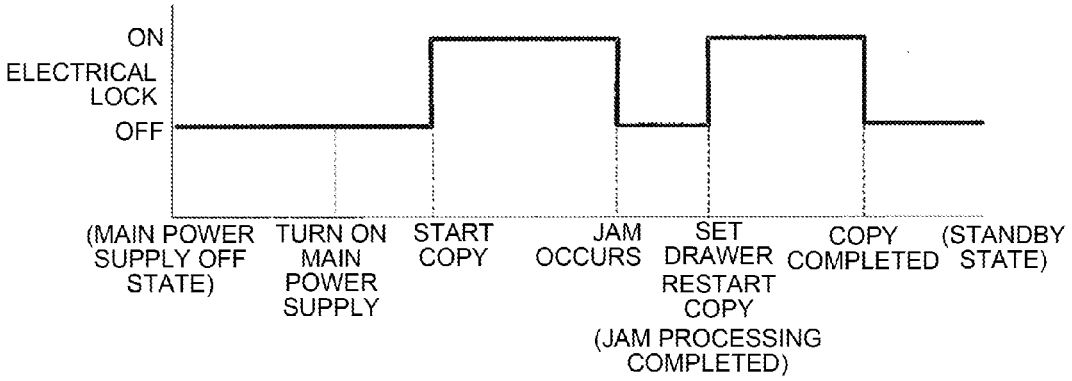
FIG. 45 is a timing chart of lock and unlock of an electrical lock mechanism.

FIG. 45 is an example of a timing chart of the lock and unlock of the electrical lock mechanism 160 when a copy operation is performed by turning ON the main power supply from the state in which the main power supply is OFF and a paper jam occurs during the copy operation.

When the main power supply is OFF, the lock by the electrical lock mechanism 160 is released and the drawer unit 76 can be pulled out. Also during a period of time from when the main power supply is turned ON to when the copy operation is started, the lock by the electrical lock mechanism 160 is released and the drawer unit 76 can be pulled out. When the copy operation is started, the lock by the electrical lock mechanism 160 is performed and the drawer unit 76 cannot be pulled out.

If a paper jam occurs during the copy operation, the copy operation is interrupted and the lock by the electrical lock mechanism 160 is released so that the drawer unit 76 can be pulled out, and the paper jam processing can be performed by pulling out the drawer unit 76. When the paper jam processing is completed and the drawer unit 76 is set in the apparatus main body unit 5, the copy operation is restarted, the lock by the electrical lock mechanism 160 is performed, and the drawer unit 76 cannot be pulled out during the copy operation.

When the copy operation is completed and the image forming apparatus is in a standby state, the lock by the electrical lock mechanism 160 is released and the drawer unit 76 can be pulled out. For example, when the image forming apparatus is not used for a long time, if the main power supply of the image forming apparatus in the standby state is turned OFF, the state in which the lock by the electrical lock mechanism 160 is released is maintained.

In this way, when the main power supply is OFF, the lock by the electrical lock mechanism 160 is released and the drawer unit 76 can be pulled out. Therefore, in the present embodiment, the drawer unit 76 is locked to the apparatus main body unit 5 by the mechanical lock mechanism 260 so that the drawer unit 76 does not protrude from the apparatus main body unit 5 by vibration due to earthquake or the like. Thereby, it is possible to prevent the drawer unit 76 from abruptly protruding from the apparatus main body unit 5 by vibration due to earthquake or the like, colliding with the user, and injuring the user. Differently from a case in which the lock by the electrical lock mechanism 160 is performed in the state in which the main power supply is OFF, the lock can be easily released by the mechanical lock mechanism 260 even when the main power supply is OFF. Therefore, even when the power supply is OFF, a maintenance operation or the like can be performed by freely pulling out the drawer unit 76.

When the main power supply is turned ON from the state in which the main power supply is OFF, the lock by the electrical lock mechanism 160 may be performed so that the drawer unit 76 cannot be pulled out. In this case, if the user presses a power supply switch to turn OFF the main power supply in a standby state in which the copy operation is not performed and the power supply is turned OFF quickly, the lock by the electrical lock mechanism 160 is still performed. Thus, the drawer unit 76 cannot be pulled out when the power supply is OFF.

Therefore, in the image forming apparatus of the present embodiment, even when the user presses the power supply switch to turn OFF the main power supply, the power supply is not turned OFF quickly, but the power supply is turned OFF after the control unit 121 performs a predetermined ending sequence. The ending sequence includes a process to release the lock by the electrical lock mechanism 160, so that it is possible to avoid a case in which the lock by the electrical lock mechanism 160 is still performed when the power supply is turned off and the drawer unit 76 cannot be pulled out.

The above description is an example, and the present invention has a specific effect for each aspect described below.

Aspect A

An image forming apparatus including an image forming means such as the tandem image forming apparatus 50 that forms an image, a drawer unit such as the drawer unit 76 configured to be able to be pulled out from an apparatus main body, and a first lock means such as the electrical lock mechanism 160 that receives power from a power supply and performs at least one of lock and unlock of the drawer unit with respect to the apparatus main body further includes a second lock means such as the mechanical lock mechanism 260 that performs lock and unlock of the drawer unit with respect to the apparatus main body by a mechanical operation performed by an operator. According to this, as described on the above embodiment, the drawer unit can be pulled out even when the power supply is OFF while preventing the drawer unit from abruptly protruding.

Aspect B

Aspect A further includes a power supply control means such as the control unit 121 that turns ON/OFF the power supply and the first lock means releases the lock of the drawer unit to the apparatus main body on the basis of a control signal that turns OFF the power supply by the power supply control means. According to this, as described on the above embodiment, it is possible to prevent the drawer unit from not being able to be pulled out by being locked by the first lock means when the power supply is OFF.

Aspect C

Aspect A or Aspect B further includes a paper jam detection means such as a paper detection sensor that detects a jam of a recording medium in a conveyance path included in the drawer unit and the first lock means release the lock of the drawer unit to the apparatus main body on the basis of a detection result of the paper jam detection means. According to this, as described on the above embodiment, it is possible to perform paper jam processing by pulling out the drawer unit.

Aspect D in Aspect A, Aspect B, or Aspect C, an exterior cover such as the front cover 6 of the apparatus main body is attached to the drawer unit. According to this, as described on the above embodiment, it is possible to pull out the drawer unit by only pulling out the exterior cover. Thereby, the operation to pull out the drawer unit is performed by one action, so that it is possible to improve work efficiency of the paper jam processing.

Aspect E

In Aspect D, the second lock means is provided inside the exterior cover and the exterior cover can be removed from the apparatus main body along with the second lock means. According to this, as described on the above embodiment, it is possible to prevent a removal operation of the exterior cover from being troublesome during maintenance.

Aspect F

Aspect A, B, C, D, or E further includes lock receiving portions such as the lock receiving surfaces 182*a* and 182*b* that come into contact with the first lock means when the drawing unit is locked to the apparatus main body and the lock receiving portions are provided on the drawer unit side of a rear side plate of the apparatus main body in the pulling out direction of the drawer unit. According to this, it is possible to prevent the first lock means from protruding backward from the rear side plate such as the main body rear plate 501 when the drawer unit is locked. Thereby, there is no limitation on an arrangement of components such as the secondary transfer roller, which are provided behind the rear side plate. It is possible to provide components such as the secondary transfer roller, which are provided behind the rear side plate, so as to face the lock receiving portions, so that it is possible to increase the flexibility of arrangement of components such as the secondary transfer roller, which are provided behind the rear side plate. Further, it is possible to reduce the size of the apparatus.

Aspect G in Aspect F, it is configured so that when the first lock means comes into contact with the lock receiving portions and the drawer unit is locked to the apparatus main body, the first lock means does not protrude from the rear side plate. According to this, as described on the above embodiment, it is possible to increase the flexibility of arrangement of components such as the secondary transfer roller, which are provided behind the rear side plate. Further, it is possible to reduce the size of the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image forming unit configured to form an image;

a drawer unit configured to be pulled out from a body of the image forming apparatus, the drawer unit including a drawer unit front plate and a drawer unit rear plate;

a shaft supported by the drawer unit rear plate;

a drive unit configured to drive and rotate the shaft, the drive unit being provided on the drawer unit front plate;

a first lock unit configured to receive power from a power supply and perform at least one of lock and unlock of the drawer unit with respect to the body, the first lock unit being provided at a rear end portion of the shaft; and a second lock unit configured to perform lock and unlock of the drawer unit with respect to the body by a mechanical operation performed by an operator, wherein in a state where the first lock unit is performing the lock of the drawer unit, the drawer unit is unable to be pulled out even when the second lock unit performs the unlock of the drawer unit.

2. The image forming apparatus according to claim 1, further comprising a power supply control unit configured to turn ON/OFF the power supply, wherein the first lock unit is configured to unlock the drawer unit to the body on the basis of a control signal for turning OFF the power supply by the power supply control unit.

3. The image forming apparatus according to claim 1, further comprising a paper jam detection unit configured to detect a jam of a recording medium in a conveyance path included in the drawer unit, wherein the first lock unit is configured to unlock the drawer unit to the body on the basis of a detection result of the paper jam detection unit.

4. The image forming apparatus according to claim 1, wherein an exterior cover of the body is attached to the drawer unit.

5. The image forming apparatus according to claim 4, wherein the second lock unit is provided inside the exterior cover such that the exterior cover is removable from the body along with the second lock unit.

6. The image forming apparatus according to claim 1, further comprising a lock receiving unit configured to come into contact with the first lock unit when the drawer unit is locked to the body, wherein the lock receiving unit is provided on the drawer unit side of a rear side plate of the body in the pulling-out direction of the drawer unit.

7. The image forming apparatus according to claim 6, wherein the first lock unit is configured not to protrude from the rear side plate when the first lock unit comes into contact with the lock receiving unit and the drawer unit is locked to the body.

8. The image forming apparatus according to claim 4, wherein the second lock unit is inside the exterior cover of the drawer unit and a handle portion is provided in the exterior cover.

9. The image forming apparatus according to claim 1, wherein the first lock unit performs the unlock of the drawer unit when an image forming operation is on standby while a main power supply is ON, when a paper jam occurs, when a serviceman is called, or when the main power supply is OFF.

10. The image forming apparatus according to claim 1, wherein the first lock unit and the second lock unit are housed in the drawer unit.

* * * * *